US005619821A

United States Patent [19]

St. George et al.

[11] Patent Number: 5,619,821

[45] Date of Patent: Apr. 15, 1997

[54] EASILY-INSTALLED QUICK-RELEASE LOCKING MODULAR SECURITY GRILL WITH OPTIONALLY AFFIXED PENETRATION-RESISTANT ROTATING FINS SERVING AS LOUVERS AND AS A SECURITY SHIELD

[75] Inventors: Charles W. St. George, Lakemba, Australia; Craig Adams, Medford, Oreg.; Donald Gonrowski, Scappoosh, Oreg.; William Rose, Grants Pass, Oreg.

[73] Assignee: Lockinbar, Inc., Portland, Oreg.

[21] Appl. No.: 494,499

[22] Filed: Jun. 26, 1995

[51] Int. Cl.[6] ..... E06B 3/68

[52] U.S. Cl. ..... 49/57; 49/64; 49/141; 109/16

[58] Field of Search ..... 49/64, 51, 57, 49/56, 141; 109/15, 16, 11, 12, 64, 73, 74, 76

[56] References Cited

U.S. PATENT DOCUMENTS

| | | | |
|---|---|---|---|
| 1,006,029 | 10/1911 | Wade | 109/16 |
| 1,893,459 | 1/1933 | Thomas | 109/16 X |
| 3,113,355 | 12/1963 | Tracy et al. | 49/51 X |
| 4,005,662 | 2/1977 | Kohn et al. | 109/16 |
| 4,400,911 | 8/1983 | Bell et al. | 49/57 X |
| 4,694,608 | 9/1987 | Lambert | 49/64 X |
| 5,269,096 | 12/1993 | Hade | 49/57 |

*Primary Examiner*—Philip C. Kannan
*Attorney, Agent, or Firm*—William C. Fuess

[57] ABSTRACT

A spring-loaded quick-release mechanism to a locking security grille is triggered by (i) manual activation, preferably through a foot switch, or (ii) fire, typically through a thermal fuse. Fins incorporated in, and/or affixed to the bars of, a security grille are preferably rotating, normally in phase, so as to serve as a louver or, when completely closed, an interlocked security shield, or panel. One locking release mechanism, which may optionally be quick release, has a sliding bar with alternate (i) extension and (ii) notch regions that respective engage the ends of solid, purely cylindrical, elongate prisms, normally cylindrical bars, to respective lock, and disengage, these prisms in a security grille. Finally, a security grille with standard universal retention assemblies variously serves to retain any, and any combinations, of tubular bars, solid bars, fins mounted to bars, and solid fins. Any of these spanning elements may variously be made from at least both plastic and metal, and are substantially visually undetectably different when so made.

14 Claims, 13 Drawing Sheets

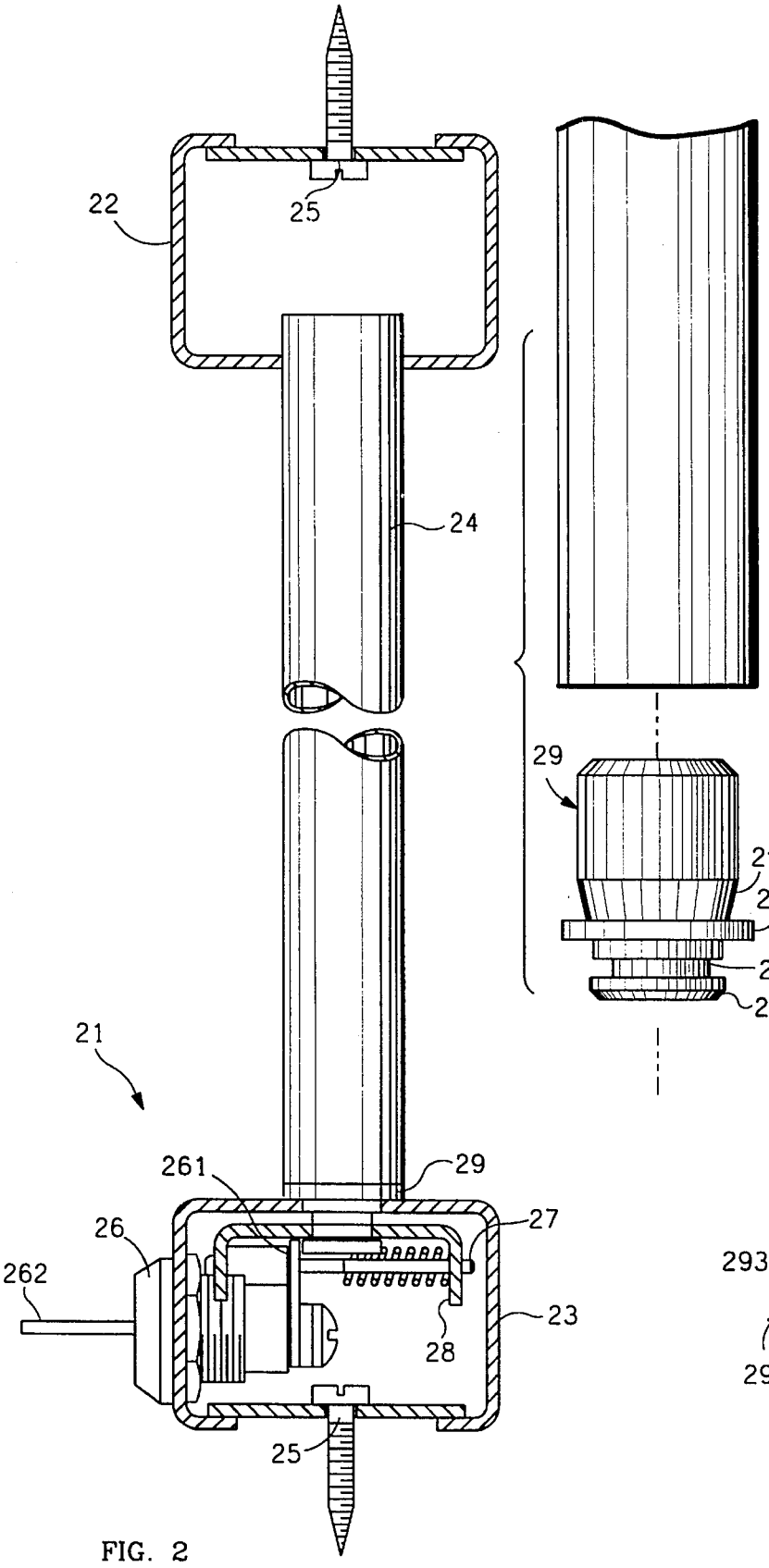
FIG. 3A
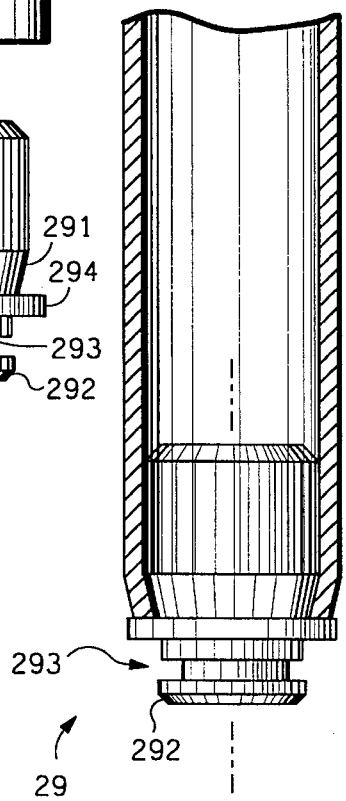
FIG. 3B
FIG. 2

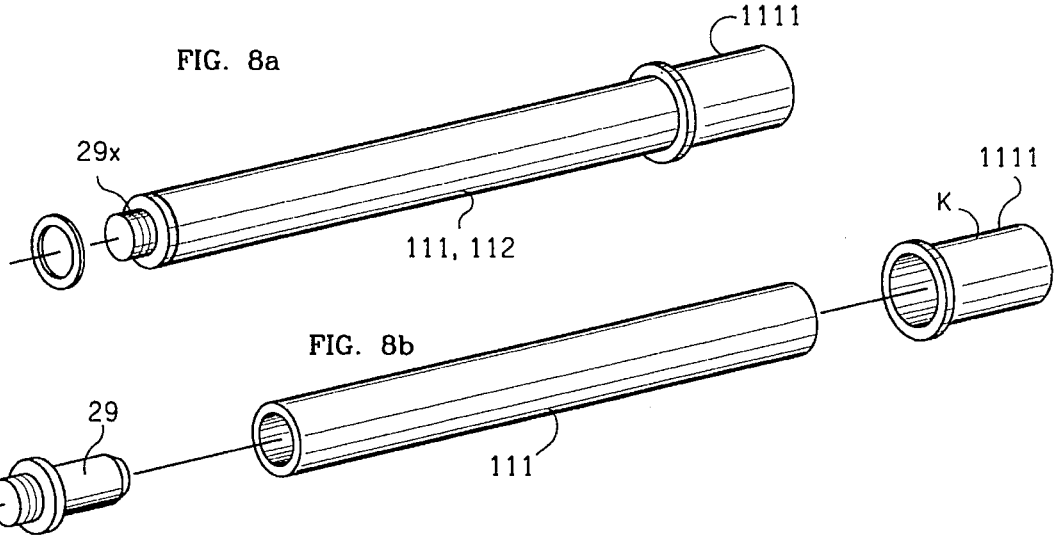
FIG. 8a
FIG. 8b
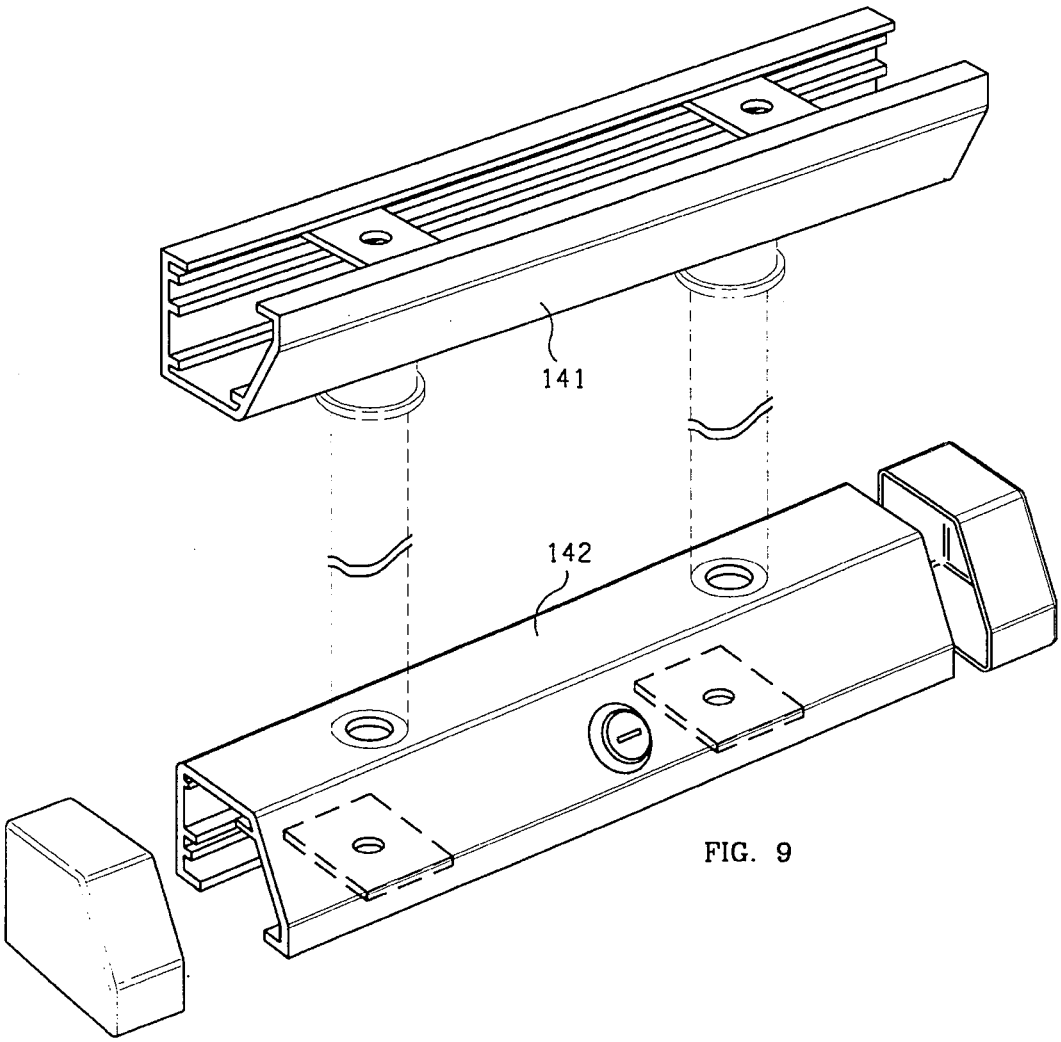
FIG. 9

EASILY-INSTALLED QUICK-RELEASE LOCKING MODULAR SECURITY GRILL WITH OPTIONALLY AFFIXED PENETRATION-RESISTANT ROTATING FINS SERVING AS LOUVERS AND AS A SECURITY SHIELD

BACKGROUND OF THE INVENTION

1. Field of the Invention

The present invention generally concerns security grilles, security bars or security shutters affixed over the window and door openings of buildings, particularly homeowner-installed internally-mounted removable security grilles for use on window openings.

The present invention particularly concerns security grilles or security bars or security shutters that are each of (i) modular, (ii) homeowner-installed (ii) selectively locked (iii) quick-releasable and quick-removable, such as in the event of fire, by a building occupant, (iv) automatically released in the event of fire, (v) substantially maintenance free, (vi) cooperatively interactive with fins that may be variously rotationally slanted so as to form both louvers and interlocking security panels, or shields, and (vii) variously configured with various combinations of any of tubular bars, solid bars, fins affixed to bars, and solid fins made from plastic and metal.

2. Description of the Prior Art 2.1 The Usage of, and Requirements for, Security Bars, Security Grilles and Security Shutters Security bars, grilles and shutters prevent unauthorized access by intruders into a building through the openings—commonly the windows—of the building. They may also serve to prevent a child from accidentally falling out of a window.

Many types of security bars, grilles and shutters are presently available. Historically, the most common types were, and are, commonly custom made. They are permanently fitted onto the outside of a building, typically during initial construction of the building. These conventional types of security bars, grilles and shutters are undesirable for precluding legitimate access through a window opening in case of emergency, especially fire. They may also impede access to windows for cleaning, or may even restrict the full opening of some kinds of windows.

Furthermore, when conventional security bars or grilles or shutters are fitted in position on the outside of a building, they are exposed to the elements and may therefore require maintenance. Because security bars, grilles and shutters are typically convolute in shape, permanent in affixation, and constructed of ferrous metals their required maintenance—normally painting—may be intricate, expensive, and frequent.

A newer type of security bar, grille or shutter is retrofittable to and at, the window and door openings of existing buildings. These security grills normally, although not necessarily, fit to the inside of windows. The security grilles of the present invention will be seen to be of this type.

In order that the fasteners, such as screws and rivets and the like, by which the newer—type security bars, grilles and shutters are affixed to existing buildings should not be readily accessible—defeating the security purpose of the bars or grille or shutter should disassembly be possible—these fasteners must be, and are normally concealed. The best security bars, grilles and shutters of the newer types conceal and protect these fasteners under structural elements that also serve to receive and to retain the bar or shutter elements. The present invention will be seen to retain this construction: the only accesses to the fasteners serving to retain a security bar or grille or shutter upon a building will be physically very well protected. Nonetheless to being well-protected, these fasteners are conveniently accessible during installation, and also thereafter if proper security conditions are met.

It is frequently desirable that any of window bars, or a security grille, or a solid security shutter, should be readily installed to, and removed from, a position barring access through a window. Sometimes security bars, grilles, or shutters will be temporarily installed because the occupants of a home or other building may at certain times and/or seasons wish to leave certain windows open, but hesitate to do so for fear that an intruder will enter through an open window. However, at other times and seasons these same people may neither require nor desire the security that is accorded by security bars or security grilles or a shutters, and may desire to remove the bars or grilles or shutters.

It may also be, at times, useful to remove window bars, or security grilles, or security shutters for purposes of cleaning the window, and/or cleaning or painting any of the window frame, the security bars, the security grille, or the security shutters.

The requirement for periodic removal of security bars, or security grilles, or security shutters, is analogous to the requirement for the periodic placement, and removal, of storm windows. However, the necessary strong physical attachment of the bars, grilles, or shutters to the building has heretofore hindered, or even precluded, ready periodic removal.

Finally, window bars, or security grilles, or security shutters must be quickly removable, and are desirably easily so removed in a foolproof manner, in the case of fire. This is both so as to permit (i) the occupants of the building to leave the building via its windows, and (ii) firemen to gain access to the interior of the building though its windows. In some areas and municipalities of the United States, releasable security bars and grilles are mandated by ordinance, especially in ground floor sleeping rooms, in order to accord the building occupants the opportunity to escape fires.

2.2 Particular Previous Removable Security Bars and Grilles

There are, in general, many different types of security bars, or security grilles, or security shutters for all the different types of window and other apertures that are presented by multitudinous different buildings, and different types of buildings.

One common type of removable security grille that is used to span the windows of common buildings normally includes a first frame member, a second frame member, and a number of bars. It is common that each frame member has and presents a number of apertures for receiving the ends of the bars, making that each bar extends from one frame member to an opposite frame member. One or both frame members may sometimes incorporate a locking mechanism that is typically movable between a first position serving to retain the bars in the frame member, and a second position which permits the egress of the bars out the frame member's apertures.

One known, and effective, locking mechanism is in the form of a strip of strong metal that is contained within the frame member. The metal strip is provided with elongate keyhole-shaped, or tapered, apertures where the diameter of each aperture varies over its length. Bars of a complimentary structure are possessed of ends in the form of a stud having regions of greater and lesser diameter. The variable diameter studs at the bar ends selectively engage the variable diameter apertures of the metal strip, providing a means of selectively locking the bars to the metal strip and to the frame member. A mechanism for retaining the metal strip in its first position locking the bars may also be provided.

An example of a particular previous removable security grille is taught within International Application number PCT AU90 00298 filed Jul. 11, 1990 and published Jan. 21, 1991, for a SECURITY GRILL. This application—descended from Australian national patent application PJ 210—was to the same Charles William St. George—a legal change of name from Charles Giorgio having in the interim transpired—who is a co-inventor of the present application.

In the predecessor application a security grille has and presents opposed first and second support members that are adapted to fit against respective opposed surface portions of a building opening. The security grille further includes a plurality of bar members that are assembled into, and that extend between, the first and second support members.

The first support member preferably includes a first engagement mechanism for either releasing or retaining the first ends of the bars. The second support member includes a second engagement mechanism moveable between (i) a first position locking and retaining the bars in place, and (ii) a second position unlocking the bars and releasing them from the second support member.

The second engagement means is preferably accessible, and actuated, only from one side—the inside—of the building's opening.

The fasteners—normally screws—by which the housing is attached to the building at the location of its window opening are mechanically shielded by affixation of the bar members in the housing.

The second engagement mechanism of the security grille typically includes a locking slide mounted for sliding inside the second support member, and a lock to retain the slide in its first position. Openings in both the second support member and the slide accept the stud ends of the bars. When the slide is in its first position, the stud ends of the bars are engaged, and the bars are held. Conversely, when the slide is in its second position, the stud ends of the bars are disengaged, and the bars are released. Also when the slide is in its first position, notches in the slide to fit a cam pin of a lock. A slide may be cut to any length, and will serve to selectively hold and release many bars, one bar per opening.

Provision may be made to reduce chances of the slide jamming, especially upon application of the first and second support members to uneven surfaces. For example, the slide may be formed from a number of like slide segments which are connected to each other in an articulated manner. In this manner the individual slide segments can slide within the support member even if the support member becomes warped as a result of its application to an uneven surface.

2.3 Objects of the Present Invention

According to certain basic catch and release mechanisms for security bars and grilles and shutters being within the prior art, the present invention is directed to improvements in the construction of these mechanisms, and also of the security bars, grilles and shutters themselves.

One object of the present invention is the design of aesthetically pleasing (i) security bars/grilles, and (ii) mounting structures for the bars/grilles. The mounting structures, in particular, would preferably be hardly noticeable. They would require no, or only but slight, changes in or to the meeting check rails of the top and bottom sashes of existing windows in order to receive such mounting structures. The mounting structures would desirably be capable of being built into new window frames so as to take the place of the parting strip between the runways for the upper and the lower sash.

Another object of the present invention is the design of security bars/grilles/shutters that may be mounted equally easily, and that may function for all purposes equally effectively, when the bars run either vertically, as is most common, or horizontally.

Another object of the present invention is the design of security bars and grilles and shutters so that their bars or louvers or other spanning elements may readily be interlocked with their associated mounting members. The interlocking is preferably by operation of one or more common lock bars each of which serves to lock, and to unlock, a number of spanning elements in common. It is mandatory that, when locked in position, access cannot be had to unlock the spanning elements from outside the building. Neither the number of locking bars or other spanning elements, nor of unlock mechanisms, is necessarily equal to the number of separate security bars or grilles spanning the openings of one more closely situated windows. In fact, the number of locking and unlocking mechanisms are desirably minimal consistent with providing safe paths of egress from inside the building in the event of fire.

Still another object of the present invention is to provide simple, substantial and practical window security bars, grilles and/or shutters that are readily capable of simple installation by amateurs, and of subsequent effective use, on windows of various heights and widths. Despite the desired easy installation of security bars, grilles and/or shutters to windows of various heights and widths, it is desired by the manufacturer(s), distributor(s) and/or retailer(s) of these security bars, grilles and shutters to make, distribute and sell only a limited number of different parts, and different sizes. Accordingly, a related, and complimentary, object to the ready sizing of the security grilles is the parallel object of making the security grilles both (i) modular in construction, and (ii) susceptible of being effectively linked together so as to permit the spanning of large areas by use of multiple identical spanning elements of lesser size.

Still another object of the present invention is to provide a window guard which may be easily and readily assembled and attached to a common window frame by an amateur craftsman, typically a homeowner, by use of only (i) common safe hand tools, typically a screwdriver, and (ii) common fasteners, typically screws. Because a security grille in accordance with the present invention will be seen to function not only to protect life and property but, in the event of fire, to permit escape through the windows of guarded spaces, the requirement that a simple installation be "foolproof" is not as trivial as might be expected. Indeed, the security grille of the present invention will be seen to be preassembled in all its critical, life-securing, sections, and to be Virtually incapable of being so inexpertly or maladroitly installed so as to fail of its essential purposes.

Still another object of the present invention is to provide window security bars, or grilles or shutters, that are modular in their component parts so that, should a part be damaged or lost, then the security bar, or grille, or shutter may be repaired in its necessary parts, and at minimum cost, without the necessity of discarding substantial portions that are still usable.

Still another object of the present invention is to render security bars and grilles to be substantially corrosion resistent, and maintenance free, in use without employing such expensive materials, for example stainless steel, as would increase costs of manufacture significantly. In fact, it is desired to use low-cost low-maintenance weather-impervious materials—normally plastics and fiberglass—on exposed surfaces while using the low cost and high strength of steel for performing the security function.

Yet another object of the present invention is to provide a window guard—having connected or unconnected bars or rods that extend across the window opening—where the bars or rods may be quickly and readily removed from the fixed portions of the guard so as to permit (i) washing the window, (ii) escape of any occupants of the building though the window during fires, (iii) entrance of fire fighting personnel into the building (regardless whether any occupants have been or are present), or (iv) any other legitimate purpose. Nonetheless to being reliably and quickly and easily removable—including if needs be by small children in a state of panics and automatically upon the occurrence of fire—for all legitimate purposes, the security bars or rods must not be subject to removal from outside the building in order to defeat their security function.

Finally, it is yet another object of the present invention to improve the integration of security bars and grilles with window louvers and shutters, such as are commonly used to moderate and control of the ingress of sunlight, breezes and weather into a building, and such as may also be used (when optionally installed to the outside of a window) in the event of storm, pestilence or attack to completely seal up a window opening.

SUMMARY OF THE INVENTION

The present invention contemplates a spring-loaded quick-release mechanism to locking security bars, grilles or shutters which mechanism is each of (i) essentially foolproof of amateur installation, (ii) reliably intuitively operative to release the security bars, grille or shutter on demand by untrained persons—even including children and the physically and/or mentally feeble—even while such persons are under extreme duress such as may rise from fire or smoke, (iii) automatically operative to release the security bars or grille or shutters in the event of fire, (iv) secure, and (v) re-settable. The essential purposes of such capabilities are to permit release of the security grille (i) upon demand of a building occupant, and (ii) always in the event of fire.

The present invention further contemplates (i) the selective incorporation of, and/or affixation of, rotating fins with or on security bar, or the bars of security grills, and/or (ii) the substitution of fins for selected bars. The fins collectively serve as a louver or, when closed, an interlocked security shutter, or shield, or panel. The purpose of such capabilities are to permit that security bars or grilles, or elements thereof, may be various configured, and changed, from bars to fins and vice versa as best suits custom configuration for each particular security application, the changing environment of use, the tastes and changing tastes of the building owner, repairs, and seasonal requirements.

The present invention still further contemplates a locking release mechanism—whether quick release or not—that serves to selectively lock in position within a security grille security bars that are purely cylindrical in form and totally devoid of any special surface features, and that may be either solid or tubular. The utility of such a capability is that immensely-strong low-cost solid steel bars that are simply cut to desired length, and that have no special features whatsoever, may be effectively and cost-effectively incorporated in a releasable security grille.

Finally, the present invention contemplates a releasible security grille or shutter having standard retention assemblies that various serve to retain as spanning elements any, or any combinations, of (i) tubular bars, (ii) solid bars, (iii) fins mounted to bars, and/or (iv) solid fins any of which may be made from varying materials including at least both plastic and metal. The utility of such a flexible system of security grille or security shutter spanning elements is that (i) the same elements may be used in more than one type of security grille or security shutter, (ii) security grilles and shutters may be made similar in appearance (iii) the security grilles and shutters of similar appearance may be variously configured, and re-configured, depending upon the requirements, and changing requirements, of the building opening protected, and, importantly, (iv) visually indistinguishable spanning elements may be made to be either higher performance at higher cost where required (i.e., the use of hardened steel at ground floor windows hazarding unauthorized entry) and lower performance at lower cost where prudent and possible (i.e., the use of hard plastic in upstairs street-facing windows). Because of characteristic (iv), an intruder attempting to select and to defeat the security function of a security grille or shutter may not clearly understand what he or she is variously up against, nor be able to diagnose the security weak points of a building which, in actual fact and in order to save costs, does not truly have equally high security at all points.

One preferred affixation of the security bars and/or fins of any of the security grilles or shutters of the present invention is by the locking and unlocking action obtained by sliding a bar with apertures. By their selective affixation to (in some embodiments) or interaction with (in other embodiments) this sliding bar, the security bars and/or fins are very strongly held to support members that are themselves affixed to a building in positions about a window opening.

Nonetheless to being strongly held, the security bars and fins are preferably easily rotated in their held positions. The fins are, in particular, (i) resistant to penetration by bullets, (ii) adjustable in the manner of a louver or shutter of various slant, and, most commonly, (iii) collectively rotatable to overlapping and interlocking positions where a continuous solid panel, or shield, surface is presented.

1. Fins and Bars, and Fins Mounted on Bars

In particular, the fins of the present invention will be understood to be useable as parts of, and/or additions mounted on and to the security bars of, a security grille for a structure, normally a building, that has and presents a multi-sided, normally a four-sided, window opening.

The fins of the present invention are usable in and with security grilles having certain conventional features. A conventional security grille with which the fins of the present invention are usable commonly has and presents spanning elements—normally rods or bars each of which has a first end and a second end—that serve to span the window opening. A spanning element first-end support member is affixed to the structure at a first side of the window opening. This first-end support member serves to selectively receive and engage the first end of each of the spanning elements. Meanwhile, a spanning element second-end support member is affixed to the structure at an opposite, second, side of the window opening. This second-end support member likewise serves to selectively receive and engage, and to selectively hold, a second end, opposite to the first end, of each of the spanning elements. The spanning elements so arrayed, and so selectively held, collectively form a conventional security grille over the window.

To this existing structure of a common security grille the present invention constitutes an improvement where each of the spanning elements is individually interchangeably selected from the group consisting of both (i) bars and (ii) fins. Bars are defined as elongate prisms having a maximum cross-sectional dimension that is less than 50% of a distance of centerline separation between adjacent spanning elements in the security grill. Accordingly, arrayed bars can never serve to completely occlude the window opening. Fins are defined to be substantially planar elongate prisms having a maximum cross-sectional dimension that is more than 50% of the distance of centerline separation between adjacent spanning elements in the security grill. Should each fin equal 100% or more of this separation distance, then adjacent fins will be touching or even overlapping, and an array of several fins can, at a proper rotational position, completely occlude the opening of the window, forming a protective panel or shield.

The bars and fins are each preferably rotated in their engagements with the first-end and the second-end support members. The fins in particular serve both to form shutters and, when sufficiently large and rotated into position so as to occlude the window opening, a solid security shield.

The fins may be discrete elements wholly as strong and permanent as are the bars. They may in particular be made from either plastic or steel, they may be solid of hollow, and they may be made bulletproof.

Some or all of the fins may alternatively be realized by attaching planar sections, normally plastic but permissively also sheet metal, to existing rotatable bars. The attachment of the planar sections is normally by a process of forcibly clipping the sections into positions snap-locked to the rotatable bars. Each snap-locked fin may rotate separately from the bar to which it is affixed, but normally and preferably rotates with the bar.

Accordingly, both (i) permanent and (ii) temporary fins are virtually both visually and functionally indistinguishable. One reason for having selectively attachable fins is to permit bars to be changed to fins, and vice versa, and the seasons and tastes of the owner dictate. Another reason for having a multitude of similarly- or identically-appearing fins is deception: an intruder may not readily discern exactly where the weak, and where the strong, fins, bars, or finned bars are located.

2. A Quick-Release Mechanism for a Security Grill

Likewise to the fins, the quick-release mechanism of the present invention will be recognized to be used on, and with, a conventional housing assembly for a security grille (such as is itself commonly used on a structure having and defining a multi-sided window opening).

The common security grille again has and presents spanning elements—normally rods or bars each of which has both first and second ends one of which presents a stud portion—that span the window opening. A spanning element first-end support member is affixed to the structure at a first side of the window opening. The first-end support member serves to selectively receive and engage the first end of each of the spanning elements. Meanwhile, a spanning element second-end support member is affixed to the structure at a second side of the window opening opposite to the first side. This second-end support member likewise serves to selectively receive and engage the second end, opposite to the first end, of each of the spanning elements. The spanning elements so arrayed and held constitute a conventional security grille over the window.

In accordance with the present invention at least one of the support members includes (i) a housing, (ii) fasteners for securing the housing to the structure at a side of the structure's multi-sided window opening, and (iii) openings in the housing to accept the stud portion of each of the spanning elements. A (iv) slide, having and defining catch that is suitable to engage the stud portions of spanning elements, is mounted in the housing for sliding movement. The slide variously assumes a first, stud-locking position where the catch secures the stud portions of the spanning elements, securing the spanning elements to the housing and thus to the structure, or a second, stud-disengaging, position where the catch releases the stud portion of the spanning elements, permitting removal of the spanning elements from the housing. A locking linkage both moves the slide, and locks so as to prevent movement of the slide.

In accordance with the present invention am energy-storing, triggered, release mechanism acts upon the locking linkage so as to cause the locking linkage to move the slide from its first to its second position. The trigger for the release mechanism is preferably manually activated, and is preferably each of (i) large and prominent, (ii) remotely situated from the release mechanism and the security grille, and (iii) intuitively obvious of operation.

Notably, the release mechanism preferably stores energy in a spring. This stored energy forces the locking means to act through the linkage means to move the slide means from the first to the second position, disengaging and releasing the security bars (or fins). The preferred trigger means is a manually activated foot pedal that is remotely situated from the locking means and connected to the release mechanism by a cable.

Importantly, the energy to release the security bars, or fins, is stored within a spring, and need not be provided by a person—who may be a child, or weak, or weakened—triggering the release. Additionally, this stored energy permits of yet another advantage.

Namely, the trigger for the spring-loaded release mechanism is preferably a number of separate triggers in parallel—of which possible parallel triggers the manual foot pedal is but one. A preferred first parallel trigger is a heat-sensitive fused link. In the presence of heat from fire this link melts, triggering the release mechanism and releasing the security bars. Clearly no human intervention is required, and humans may or may not be present either inside or outside the building at the fire scene for the release mechanism to be triggered, and act to release the security bars or fins.

It is also contemplated to trigger release based on the occurrence of earthquakes, the release of gas, or other occurrences such as are known to be automatically sensed for security purposes.

Finally, it will be understood that many different manual triggers, and redundant manual triggers, are possible. If, for example, in a certain room of a certain house it is desired to make the trigger resemble, and function like, the pull cord of a common drapery, then this is easily possible. If, in another room of the same house, it is desired to make the trigger resemble, and function like, a common light switch, then this is also easily possible.

3. Security Grille Housings Receiving an Selectively Retaining Featureless Cylindrical Bars In accordance with the present invention, a locking release mechanism serves to lock solid, purely cylindrical, bars that are totally devoid of any special surface features into a security grille.

A security grille using such a locking release mechanism is for use on a structure having and defining a multi-sided window opening. The security grille includes, as well as the locking release mechanism, solid spanning elements in the shape of elongate regular prisms without differentiated features upon either their elongate surfaces or their ends. A spanning element first-end support member, affixed to the structure at a first side of the window opening, selectively receives and engages the first end of each of the spanning elements. A spanning element second-end support member, affixed to the structure at a second side of the window opening opposite to the first side, selectively receives and engages the second end, opposite to the first end, of each of the spanning elements.

Attachment elements, normally screws, attach the second-end support member to the structure at a side of the structure's multi-sided window opening. Openings in the second-end support member to accept an end portion of each of the spanning elements.

This spanning element second-end support member further includes and incorporates the locking release mechanism that is, of necessity, operational on the solid spanning elements in the shape of elongate regular prisms without differentiated features upon either their elongate surfaces or their ends.

This locking release mechanism itself is based on a slide having and defining both (i) extensions—normally simple metal tabs—suitable to butt against the end portion of each of the spanning elements, and (ii) notch means also suitable to receive the end portion of each of the spanning elements. The slide is mounted in the housing for sliding movement between (i) a first position where the extension means holds the end portion of each of the spanning elements in such extension as causes each such spanning element to be simultaneously engages and held in each of the openings in the second-end support member and in the first-end support member, and (ii) a second position where the extension means permits the end portion of each of the spanning elements to recess within the openings of the second-end support member sufficiently so as to be extracted and released from the first-end support member. A mechanical lock linkage serves to move the slide between, and to retain the slide at, each of its first, spanning element-retaining, position and its second, spanning element-disengaging, position.

The spanning elements in the shape of elongate regular prisms without differentiated features upon either their elongate surfaces or their ends thus form a releasible security grille over the window opening where the first and the second ends of the spanning elements are selectively respectively received and engaged by the first-end and the second-end support members.

4. Variously Configured Security Grilles

In accordance with the present invention, a security grille having universal standard retention assemblies may variously retain any, and any combinations, of tubular bars, solid bars, fins mounted to bars, and solid fins. Any of the tubular bars, solid bars, fins mounted to bars, and solid fins may be made from varying materials including at least both plastic and metal.

In particular, a variably configured and reconfigured security grille in accordance with the present invention includes a number of spanning elements including at least two different elements that are variously selected from the group including tubular bars, solid bars, fins affixed to bars, hollow fins, and metal fins. A universal first-end support member, affixed to the structure at a first side of the window opening, selectively receives and engages the first end of each and any of the spanning elements. A spanning element second-end support member, affixed to the structure at a second side of the window opening opposite to the first side, selectively receives and engages the second end, opposite to the first end, of each and any of the spanning elements.

These and other aspects and attributes of the present invention will become increasingly clear upon reference to the following drawings and accompanying specification.

BRIEF DESCRIPTION OF THE DRAWINGS

FIG. 2 is a cut-away cross-section view of a prior art security grille showing a prior art bar engagement and locking mechanism.

FIG. 3A is a front view in elevation of a prior art stud and tube before they are fastened together to form a security bar.

FIG. 3B is a cross-sectional view of the prior art stud and tube previously seen in FIG. 3A now affixed together into a studded tube that may serve as a one type of rotatable security bar element within a security grille of the present invention.

FIG. 8A is a perspective view of a tube or a bar, covered at one end with a cap and terminating at the other end in a stud, suitable for use in a security grille in accordance with the present invention.

FIG. 8B is an exploded perspective view of a tube, terminated at one end in a cap and at the other end in a stud insert, suitable for use in a security grille of the present invention.

FIG. 9 is a diagrammatic view particularly demonstrating how the mounting assemblies of a security grille in accordance with the present invention may be affixed to a building at positions along the axis of the bar or tube elements of the grille.

DESCRIPTION OF THE PREFERRED EMBODIMENT

Figure 1:
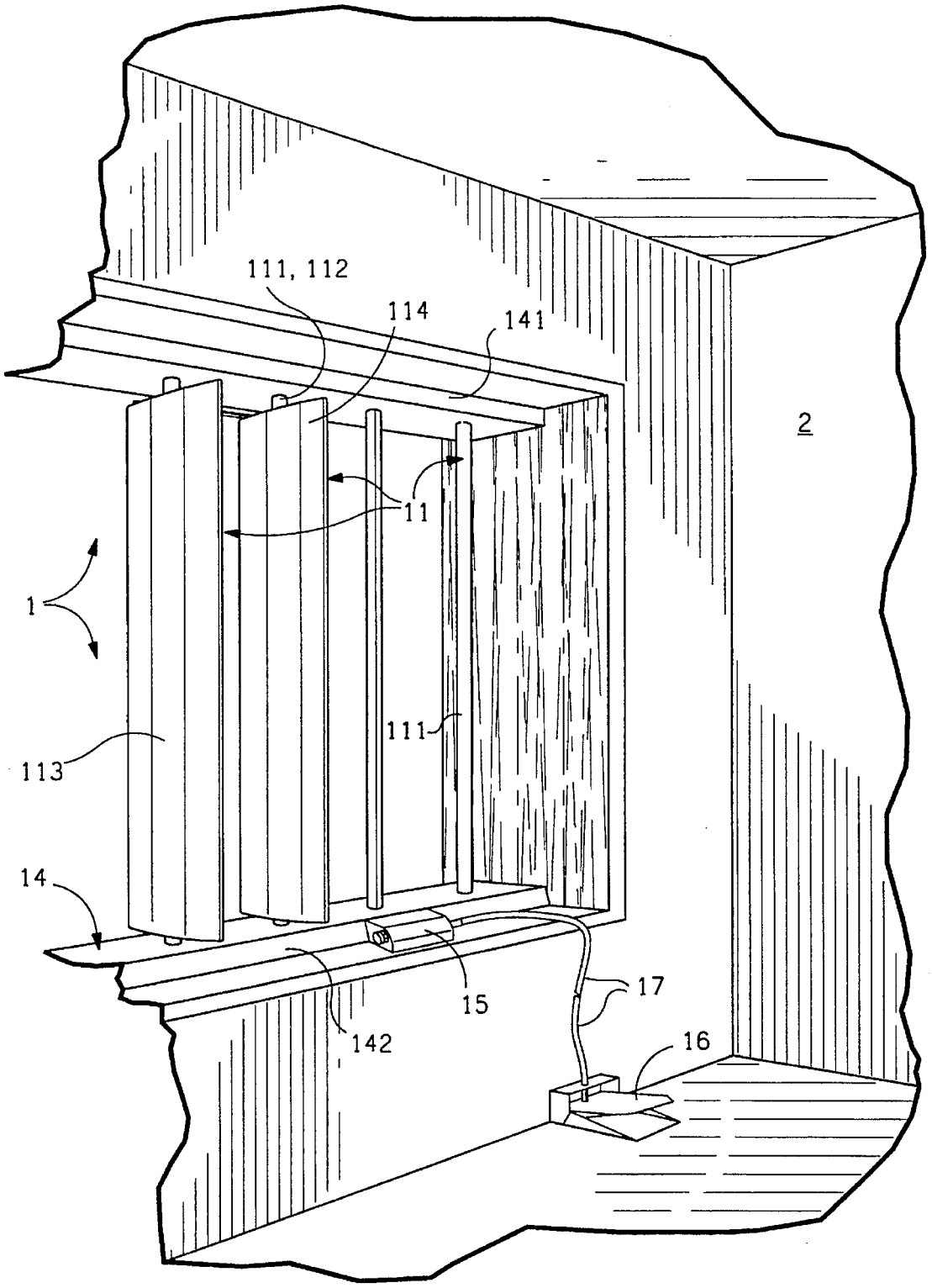
FIG. 1 is a diagrammatic perspective view of a hybrid embodiment of a modular security grille in accordance with the invention, the depicted embodiment showing a bar, two types of fin, and a quick-release mechanism.

The present invention is embodied in a releasable security grille/shutter for an opening in a building 2—normally a window opening—as illustrated in FIG. 1. The security grille/shutter 1 includes spanning elements 11 in the form of any of tubular bars 111, solid bars 112, fins 113, or snap-lock affixed fins 114. The snap-lock affixed fins 114 may in particular be affixed over either the tubular bars 111 or the solid bars 112. All the elongate spanning elements 11 are adopted to extend in any direction across any opening, being illustrated by example to extend vertically across a window opening of a building 2 (not part of the present invention) in FIG. 1.

The security grille/shutter 1 further includes hollow housings 14. All of the bars 111, 112 and fins 113, 114 are affixed at each of their two ends to housings 14, of which illustrated upper housing 141 and lower housing 142 are typical. Each of the upper housing 141 and lower housing 142 has and presents apertures into which the peg ends of the spanning elements 11—of whatsoever type—slide and are selectively retained, and in which apertures the spanning elements 11—of whatsoever type—rotate.

In accordance with the present invention, at least one of the housing assemblies 14, and normally lower housing assembly 142, is equipped with a quick release mechanism 15. Activation of the quick release mechanism 15 serves to release all of the spanning elements 11 from the lower housing 142. The released spanning elements 11 may then be individually thrust upwards (further into the apertures of hollow upper housing 141) until they escape containment. The operation of this quick release mechanism will be further shown in FIG. 4. The triggering of the quick release mechanism 15, but not the force of its operation, is provided by a human-activated remote-control actuator trigger 16, normally a foot pedal as illustrated. The foot pedal actuator trigger 16 is connected to the quick-release mechanism 15 by a control cable 17, as will be more particularly illustrated in FIG. 5.

Although the foot pedal trigger 16 is, and is illustrated to be, relatively large, its substantial size is for the purposes of its convenient unambiguous location and ready identification by a human user. To such end it is also often painted a bright color, commonly fire engine red or bright yellow.

The typically substantial size and robust construction of a human-activated remote-control actuator trigger 16 false implies that it is used to develop an actuating force, as opposed to a much lesser triggering force, for the quick release mechanism 15. In actual fact, the energy for the release is already stored in the quick release mechanism 15, as will be seen in conjunction with FIG. 4. The substantial construction of the remote-control actuator trigger 16 and the control cable 17 is also so that neither can easily be damaged, nor rendered inoperative, even under extreme conditions particularly including fire.

The large size, and the easy activation, of the foot pedal trigger 16—which is normally resident upon the floor—permits that it may be readily activated by small children and/or by adults whose strength, agility and/or mobility are impaired. The foot pedal trigger 16 may alternatively be replaced with any of (i) a hand-activated plunger or other hand-held, (ii) a cord or rope, (iii) a switch or switch box, including a wall-mounted switch similar to a light switch, or even (iv) a pull ring acting through a cable (all not shown). Similarly, because the control cable 17 will be understood to transmit a trigger activation signal—herein a mechanical trigger activation signal—and not to transmit either significant force or energy, it will be understood that the entire triggering of the quick release mechanism 15 could transpire by many different and alternative means. For example, triggering of the quick release mechanism 16 could transpire by the communication of an electrical signal, and by use of an electromechanical device, typically a solenoid, within the quick release mechanism 15.

Before proceeding to an explanation of (i) the preferred quick release mechanism 15 of the present invention, (ii) a more detailed discussion of the permanent and snap-lock affixed fins 113, 114, previously seen in FIG. 1, and (iii) a release mechanism operative with purely cylindrical rods or tubes, it is useful to undertake a review of a prior art bar locking and release mechanisms. On particular such prior art bar locking and release mechanism 21 is shown in FIG. 2. The illustrated mechanism 21 is the subject of Patent Application Number PK 7409 filed Jul. 25, 1991, in Australia, and additionally of PCT application 92 1/075 and Canada Patent Application 2,059,961-8 descended from the Australian application. The prior patent applications are to the same inventor Charles St. George (by a different name) who is a co-inventor of the present invention.

In use of the prior art bar-locking and release mechanism 21 of FIG. 2, a upper bar support member 22 and a lower bar support member 23 are each adapted to be applied and affixed to a side surfaces of an aperture (not shown), normally a window, located within a building or like structure. The bars 24 (only one of which bars 24 is shown in FIG. 2) that are affixed between, and held by, the upper bar support member 22 and the lower bar support member 23 form a security grille that will protect against unwanted intrusion though the window aperture.

Bars 24 extend between the upper support member 22 and the lower, locking, support member 23. Opposed ends of the bars 24 are engaged within appropriately located receiving apertures in each of the upper support member 22 and the lower, locking, support member 23.

In the illustrated instance, the bars 24 are tubular, presenting at the bottom of each such bar 24 (if not also at the top) a stud 29 which has a neck 29A against which the end of bar 24 is swaged. The stud 29 has an end flange 292, a narrow neck 293 and a shoulder 294—all of which may be particularly be observed in FIGS. 3A and FIGS. 3B.

A locking slide 28 is mounted for sliding in the hollow housing of the lower bar support member 23. Openings are located in the housing of the lower bar support member 23 to accept the stud 29, or locking end, of the removable bar 24. The stud ends 29 and the slide 28 have a catch means 27 operating to secure the stud 29 and the bar 24 within the housing of the lower bar support member 23 when the slide 28 is in a first position, and to release the stud 29 and bar 24 for removal from the housing of the lower bar support member 23 when the slide 28 is in a second position. A lock 26 serves to retain the slide 8 in the a first position. The openings also give access to fasteners 25 whereby the upper bar support member 22 and a lower bar support member 23 are secured to a support. The fasteners 25 are occluded from access when the bars 24 are in place inserted into in the upper bar support member 22 and into the lower bar support member 23.

In detail operation, the slide 28 has and presents apertures which are elongated along the long axis of the slide, which axis is orthogonal to the plane of the drawings FIG. 2. These elongated apertures are in the shape of a key hole, or a trapezoid, or other geometric figure exhibiting a varying width. The slide 28 moves by sliding within, and is guided by, the interior of the lower, locking, bar support member 23. In such movement relatively wider, and narrower portions, of the apertures are disposed to the stud portions 29 of the bars 24.

Firstly, when the wider portion when the orifices within the slide bar 28 are disposed oppositely to the studs 29 of the bars 24, then the bars 24 are retractable, herein in an upward direction, away from the lower, locking, bar support member 23. The slide 28 is moved within the housing of the lower bar support member 23 under the influence of lock 26 acting through the intermediary of a cam 261. The lock 26 is actuated by key 262.

A locking mechanism 21 of the nature shown in FIG. 2 is required only for one end of the bars 24 because the mechanism 21 securely locks the studs 29 in a manner that prevents any sliding movement of the bars 24 (in a direction perpendicular to the direction of the sliding movement of the slide 28 within the bar support member 23 itself).

The assembly of a prior art stud 29 into a prior art tube 23 is illustrated in FIG. 3*a*, and the assembled unit is illustrated in FIG. 3*b*. The stud 29 has an end flange 292, a narrow neck 293, and a shoulder 294. A wider portion 292 at the tip of the stud serves to engage and lock the bar 24 to the lower bar support 21 (both shown in FIG. 2).

The system of tubes 23 and studs 29 shown in FIG. 3 is suitable only for thin-wall tubes 23. Such thin-wall tubes 23 may particularly be clinched at their neck regions about an inserted stud 29. However, tubes of ever increasing diameter, and/or ever more thick walls, cannot be so clinched. A stud 29 of a standard size thus cannot be used for tubes of all diameters, or wall thicknesses. Such a standard size stud 29 would be desirable so that security bars of different strength might be employed in like-externally-appearing security grilles used at different window locations of a building. Additionally, no stud 29 is suitably usable in combination with a solid security bar. The stud features could, of course, be machined into a solid bar—but this is expensive. Moreover, if a typically heavy solid bar is dropped, the stud features can be damaged.

Accordingly, and although the fins for security grilles/shutters of the present invention are usable with the standard hollow tube and stud system shown in FIG. 3, this aspect (i.e., fins) of the present invention also extends to an improved security bar retaining and releasing system that is capable of using totally solid security bars without end features. This improved security bar retaining and releasing system will ultimately be shown in conjunction with FIGS. 15 through 19.

Figure 4A:
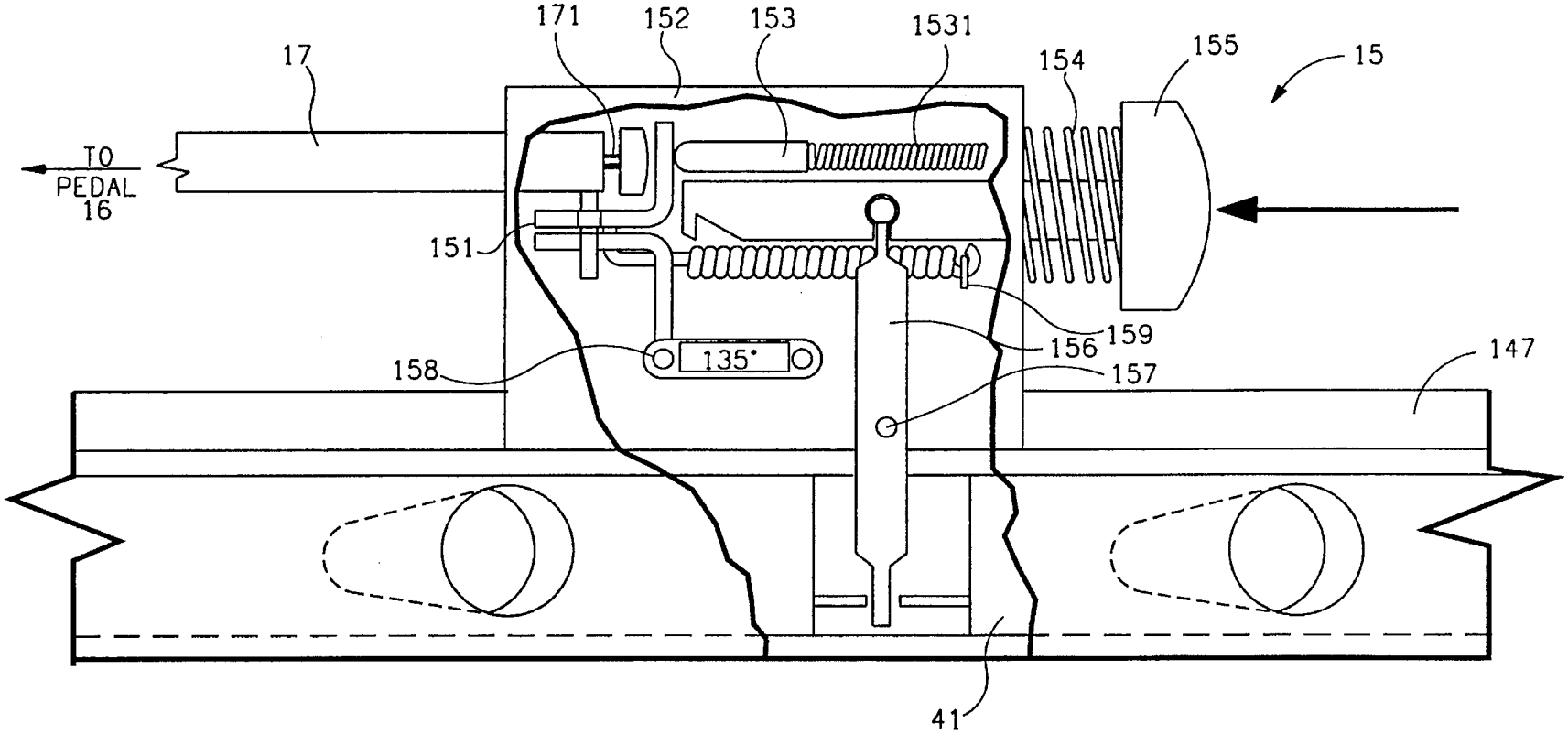
FIG. 4A is a partially cut-away view of a preferred embodiment of a quick-release mechanism of a security grille in accordance with the present invention.

Continuing now with the explanation of quick release mechanism 15 previously seen in FIG. 1, a plan view, partially in cut-away, of this quick release mechanism 15 is shown in FIG. 4*a*. The release mechanism 15 connects via cable 17 to trigger mechanism, or foot pedal, 16. It also serves to mechanically engage a sliding bar, or lock strip, 41 that is located within the lower housing assembly 142 previously seen in FIG. 1. An expanded view of the action of the elements of locking mechanism 15 associated with the trigger release are further illustrated in FIG. 4*b*.

The release mechanism 15 is intended to replace a standard key lock 26 on a the prior art security grille shown in FIG. 2. The release mechanism 15 preferably unlocks and releases all of the spanning elements 11 (shown in FIG. 1) for removal in response to at least two separate and independent stimuli: (i) human activation, and (ii) heat from fire.

In operation of the quick release mechanism 15, pressing on the foot pedal 16 (shown in FIG. 5) pushes the inner wire 171 of the control cable 17 to move the latch lever 151 within the housing 152. This movement releases the locking plunger 153 (in a manner to be more particularly shown in FIG. 4*b*) which is under pressure of spring 1531 for having been previously locked by a previous manual pressing of-the plunger 155 to its illustrated, set, position. Movement under force of spring 154 of the triggered, and unlocked, plunger 153 will move the main release lever 156 about its pivot point 157, and will move the sliding locking strip, or bar, 41 within the lower housing assembly 142. This movement will release the spanning elements 11 seen in FIG. 1.

The quick release mechanism 15 further contains a thermally-activated and triggered release. A thermal fuse link 158 is located in the housing 152. It is in good thermal contact and thermal communication with this housing 152, which is normally made of aluminum, and with the conditions outside the security grille 1. The thermal fuse link is held under tension by the thermal release spring 159, which spring 159 is also attached to the release lever 156.

In the event that the temperature near the security grille 1 rises above a predetermined level, normally 135° F., then the thermal fuse link 158 will part, causing the thermal release spring 159 to again move the latch lever 151, permitting the plunger 153 to again move the main release lever 156 under force of spring 154.

Figure 4B:
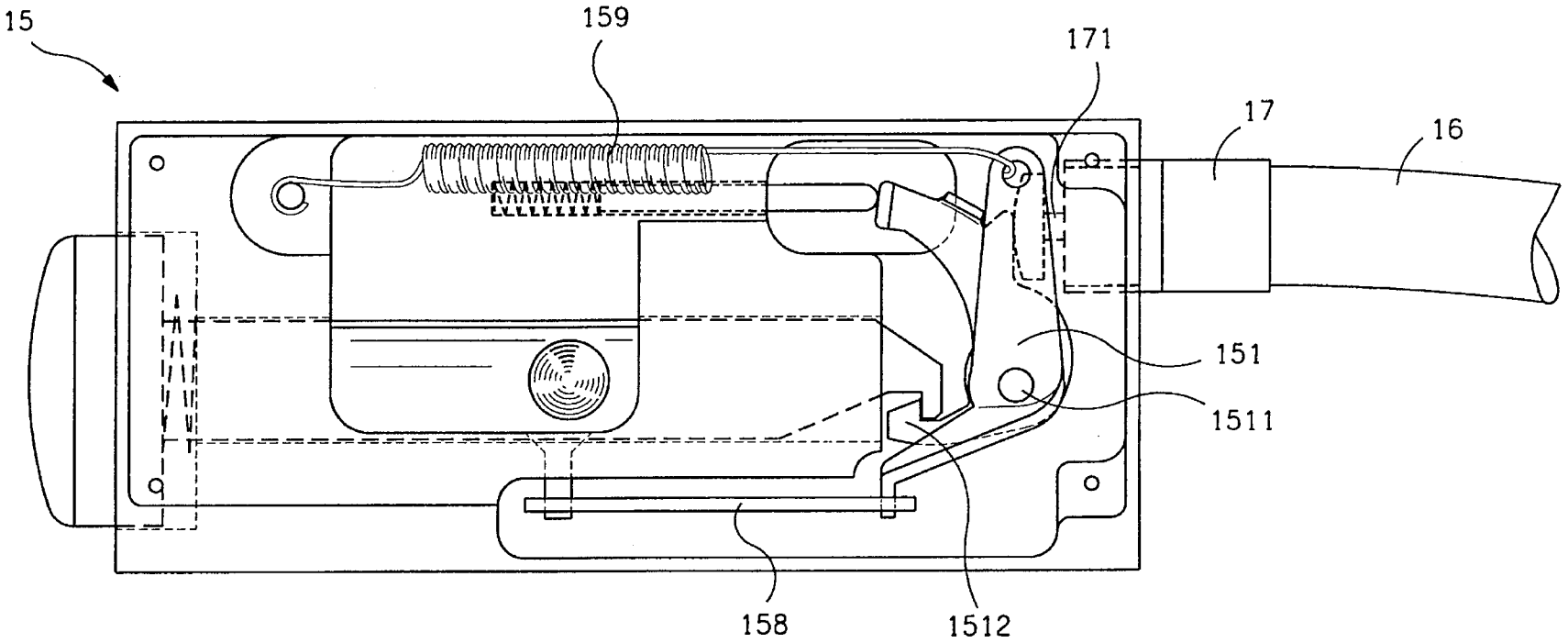
FIG. 4B is an expanded detailed diagrammatic perspective view of the lock and release mechanism of the quick-release mechanism of the security grille of the present invention previously shown in FIG. 4A.

The detail construction of the latch lever 151 is shown in FIG. 4b. The latch lever 151 pivots about the pivot point 1511. Clearly one force that permits it to do so is the force is a pushing force from the inner wire 171 of the control cable 17 which causes the catch 1512 to disengage the locking plunger 153. Clearly another, alternative, force that so causes the latch lever 151 to pivot about its pivot point 1511, again disengaging the locking plunger 153, is the force of thermal release spring 159. This spring 159 is permitted to pivot the latch lever 151 if, and only if, the thermal fuse link 159 separates. The latch lever 151 is normally maintained reliably set, or locked, under normal conditions including vibration by the force of spring 1531.

Figure 5:
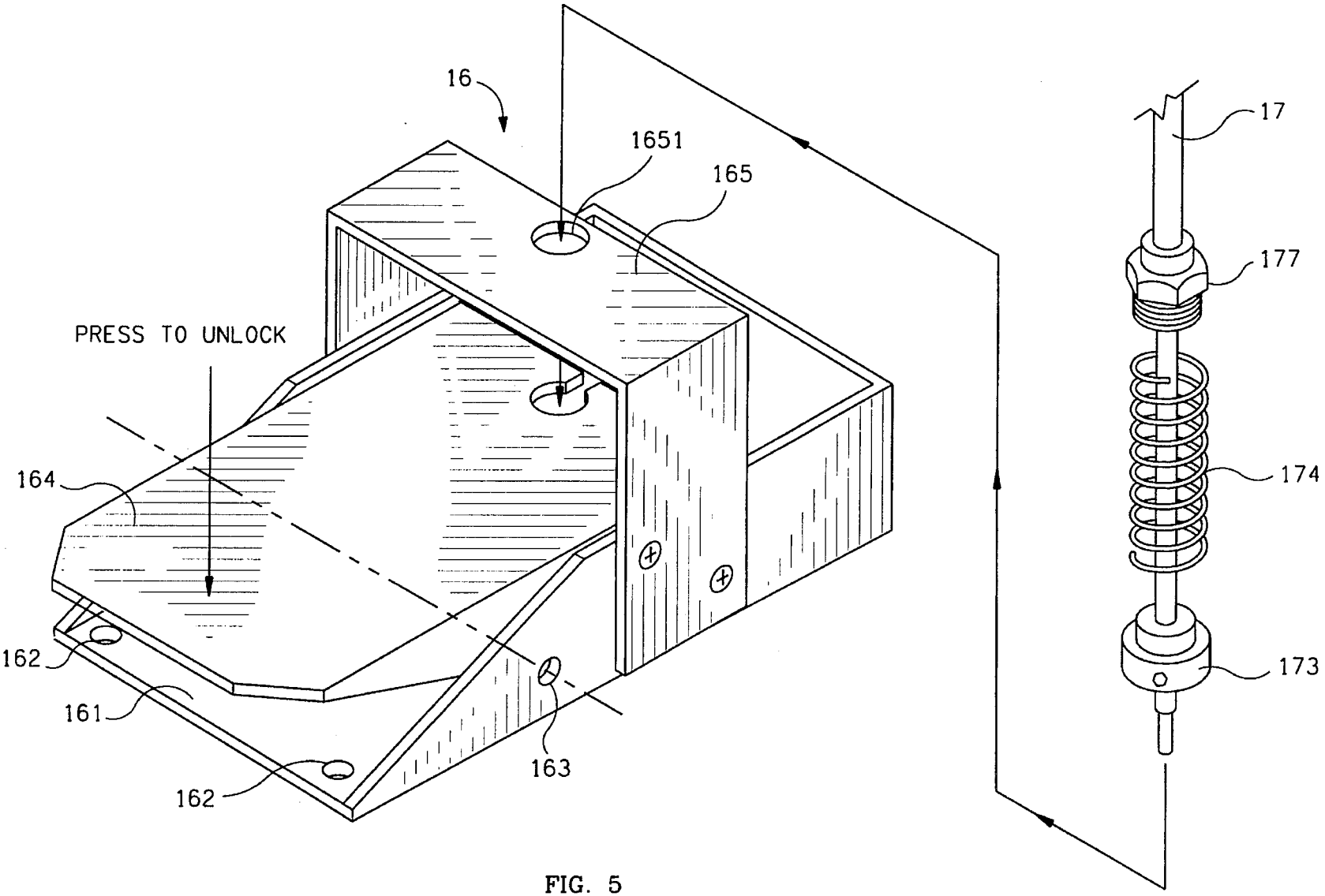
FIG. 5 is a diagrammatic perspective view, partially exploded, showing the foot pad trigger to the quick-release mechanism of the security grille in accordance with the present invention.

An exploded view of the preferred embodiment of a actuator trigger mechanism in the form of a foot pedal 16, and also of the control cable 17, is shown in FIG. 5. A mounting base 161 of the foot pedal 16 may be secured in any position to any surface through mounting holes 162. A bracket 165 may be mounted in either the vertical position illustrated in solid line, or in the horizontal position. The bracket 165 holds the end fixture 172 of the control cable 17 in its aperture 1651.

A release pedal 164 pivots about pivot, or rotation, axis 163. It is moved under force of in the direction of vector arrow PRESS TO UNLOCK. This movement presses against the cable stop 173, and moves the cable stop 173 of the control cable 171 against the force of return spring 174. This movement causes the internal wire of the control cable to extend through the cable 17 and directionally away from the actuator trigger mechanism in the form of the foot pedal 16 so as to ultimately be manifest as pushing force at the cable end 171 within the quick release mechanism 15 (shown in FIG. 4).

Figure 6A:
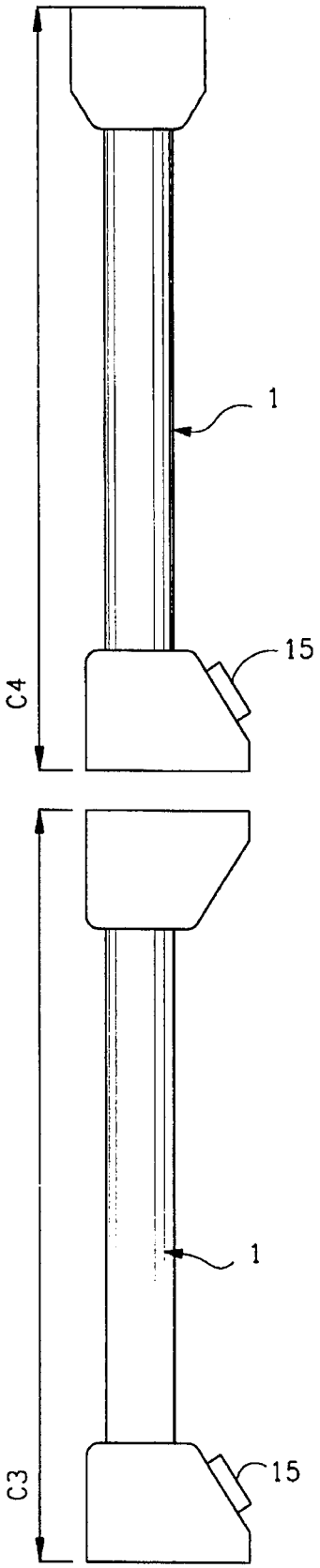
FIG. 6A is a side plan view of two separately arrayed security grilles in accordance with the present invention.

A side plan view of two separately arrayed security grilles 1 in accordance with the present invention as might cover two separate openings of a building 2 (shown in FIG. 1) is shown in FIG. 6*a*. The distances C3 and C4 may particularly be the height, or the width depending upon orientation of the security grille 1, of the openings, normally the window openings, spanned. The distances C3 and C4 need not be the same distance.

Figure 6B:
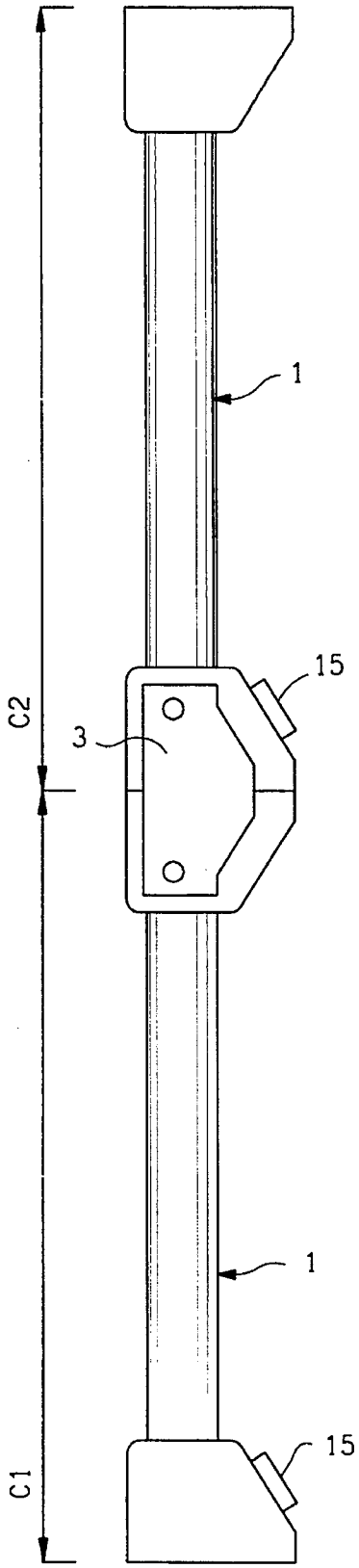
FIG. 6B is a side plan view of two connected security grilles in accordance with the present invention, each of which grilles is separately quick-releasable.

A side plan view of two connected security grilles 1 in accordance with the present invention is shown in FIG. 6*b*. The distances C1 and C2 combined may particularly be the height, or the width, of the opening spanned. The distances C1 and C2 need not be the same distance. An external bracket 3 may be used to join the security grilles i together. Each of the security grilles 1 is separately quick releasable.

Figure 6C:
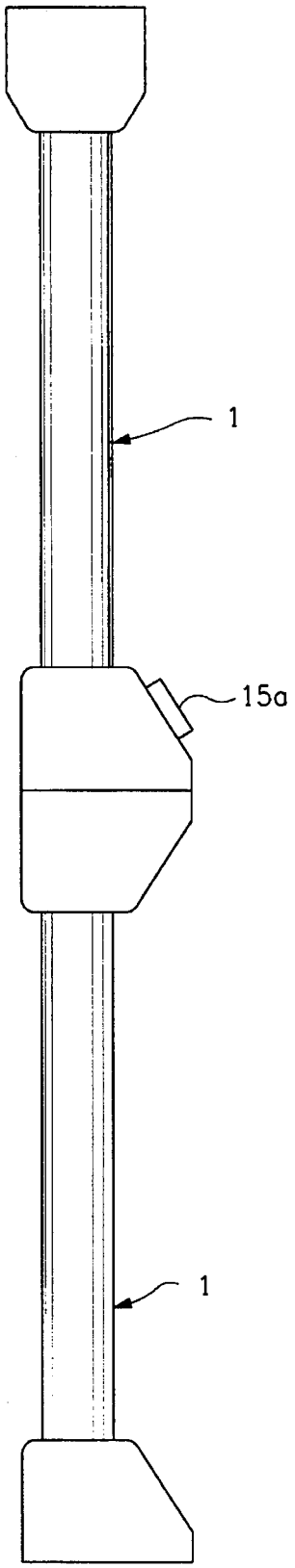
FIG. 6C is a side plan view of two connected security grilles in accordance with the present invention wherein both grilles are jointly quick-releasable by a unified mechanism.

A side plan view, similar to FIG. 6*b*, of two connected security grilles 1 in accordance with the present invention wherein both grilles are jointly quick-releasable by a unified quick-release mechanism 15 is shown in FIG. 6*c*. Moreover, the unified mechanism 15*a* may join the grilles 1, obviating the need for bracket 3 (shown in FIG. 6*b*).

Figure 7B:
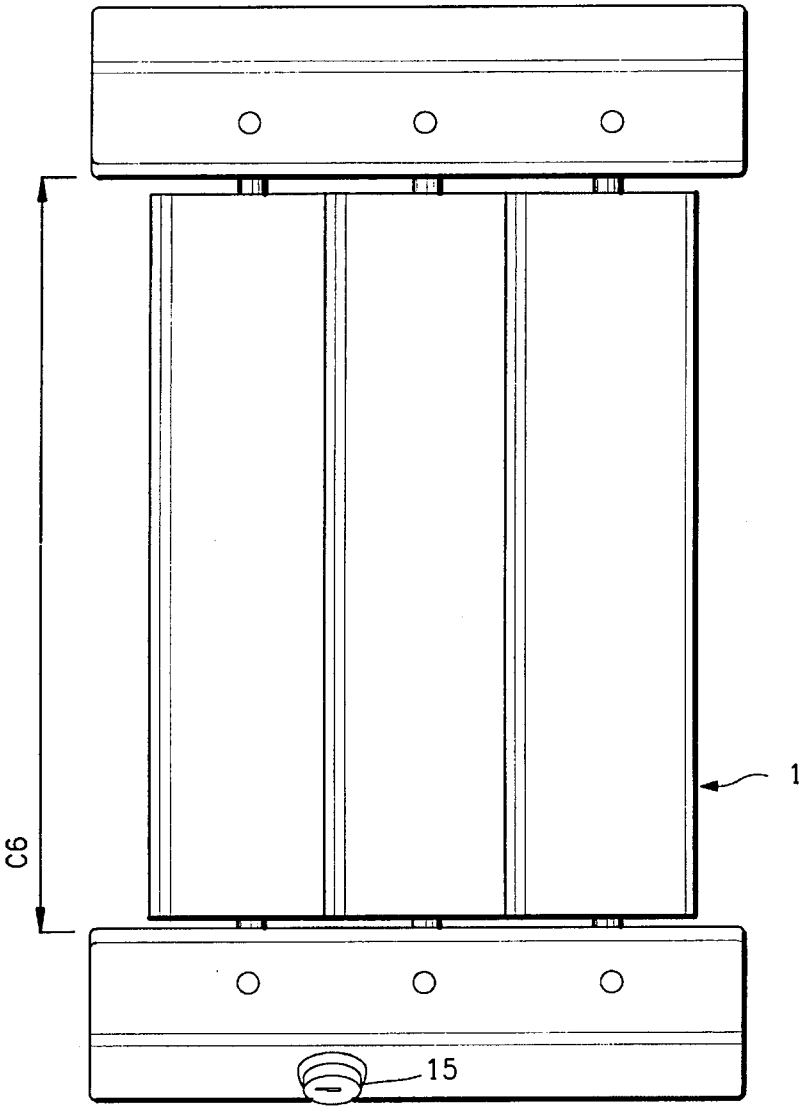
FIG. 7B is a front plan view of the same security grille in an embodiment having and presenting interlocking fins.
Figure 7A:
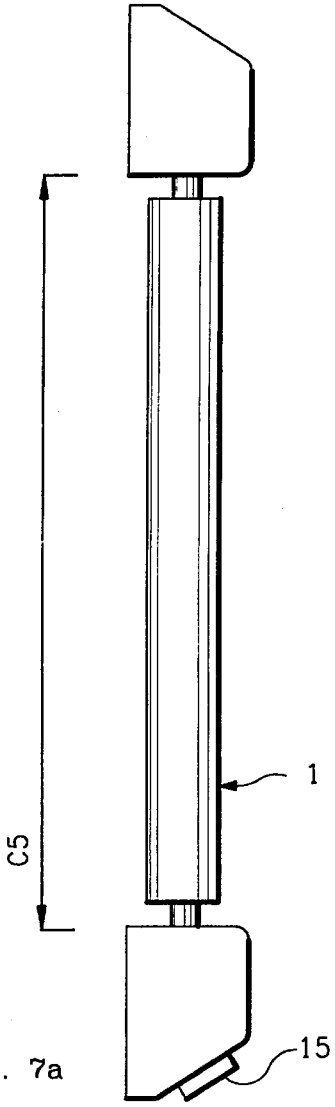
FIG. 7A is a side plan view of a single security grille in accordance with the present invention.

A side plan view of a single security grille 1 in accordance with the present invention rendered in an embodiment having interlocking fins is shown in FIG. 7*a*. The front plan view of the same security grille 1 having and presenting interlocking fins is shown in FIG. 7*b*. Distances C5 and C6 are related to the opening spanned.

A perspective view of a tube 111 or a bar 112, covered at one end with a cap 111 and terminating at the other end in a stud feature 29*x*, that is suitable for use in a security grille 1 in accordance with the present invention is shown in FIG. 8*a*. An exploded perspective view particularly of a tube 111, terminated at one end in the cap 1111 and at the other end in the same stud insert 29 (previously seen in FIG. 2 as part of the prior art) that is also suitable for use in a security grille 1 of the present invention is shown in FIG. 8B.

A diagrammatic view particularly demonstrating how the mounting, or housing, assemblies 14, 142 of a security grille 1 in accordance with the present invention may be affixed to a building 2 (shown in FIG. 1) at positions along the axis of the spanning elements 11 of the grille 1 is shown in FIG. 9. Nonetheless to this showing of FIG. 9, FIG. 9 is included primarily not as new teaching, but as a baseline from which the further evolutions of FIGS. 10–13 may usefully be compared.

Figure 10:
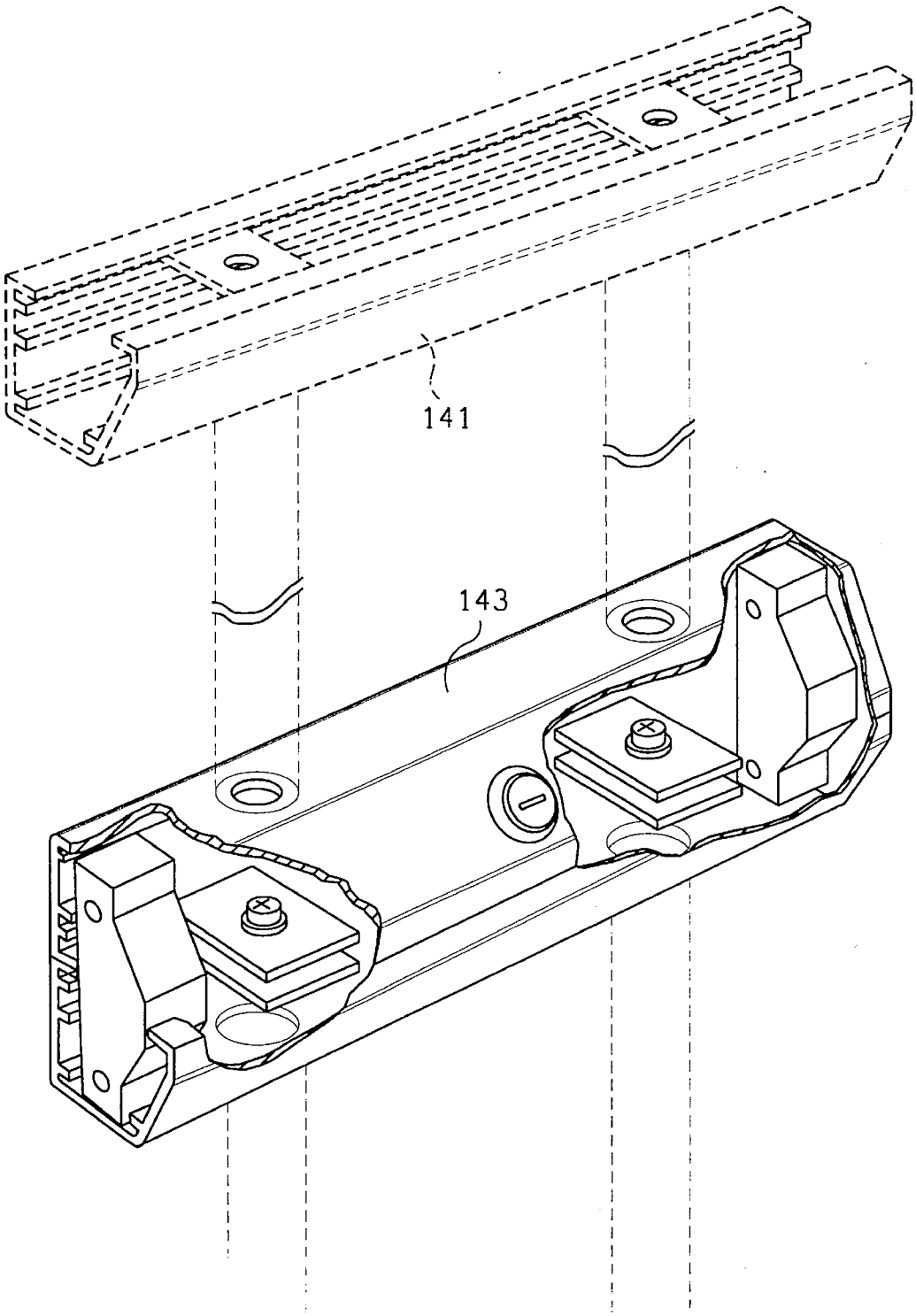
FIG. 10 is a diagrammatic perspective view of a single mounting element which is in common to two security grilles in accordance with the present invention.
Figure 11:
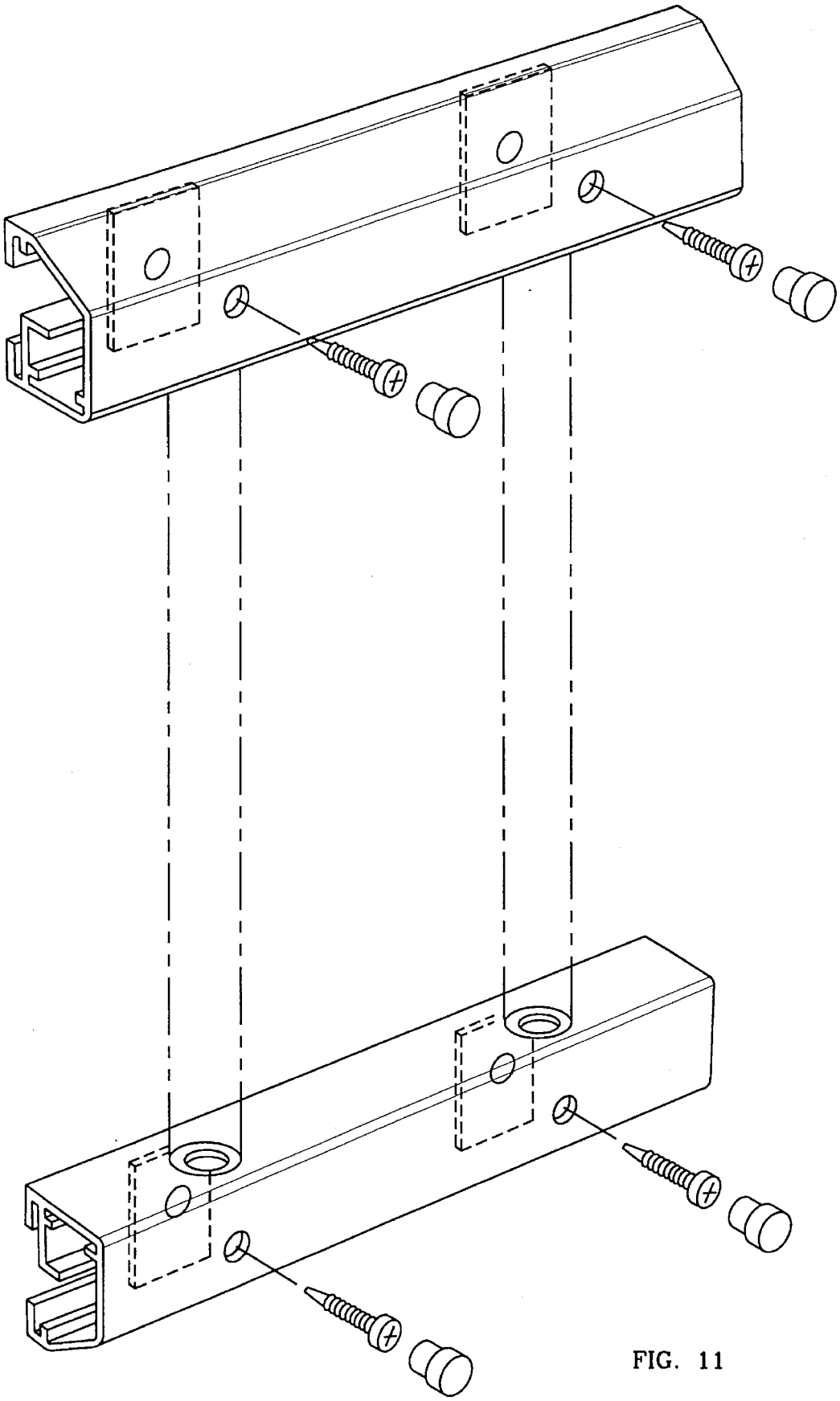
FIG. 11 is an exploded diagrammatic view particularly showing how the mounting assemblies of a security grille in accordance with the present invention may be affixed to a building at positions orthogonal to the axis of the bars or tubes of such security grilles.

A diagrammatic perspective view of a single mounting, or housing, assembly 143 which is in Common to two security grilles 1 in accordance with the present invention is shown in FIG. 10.

Figure 12:
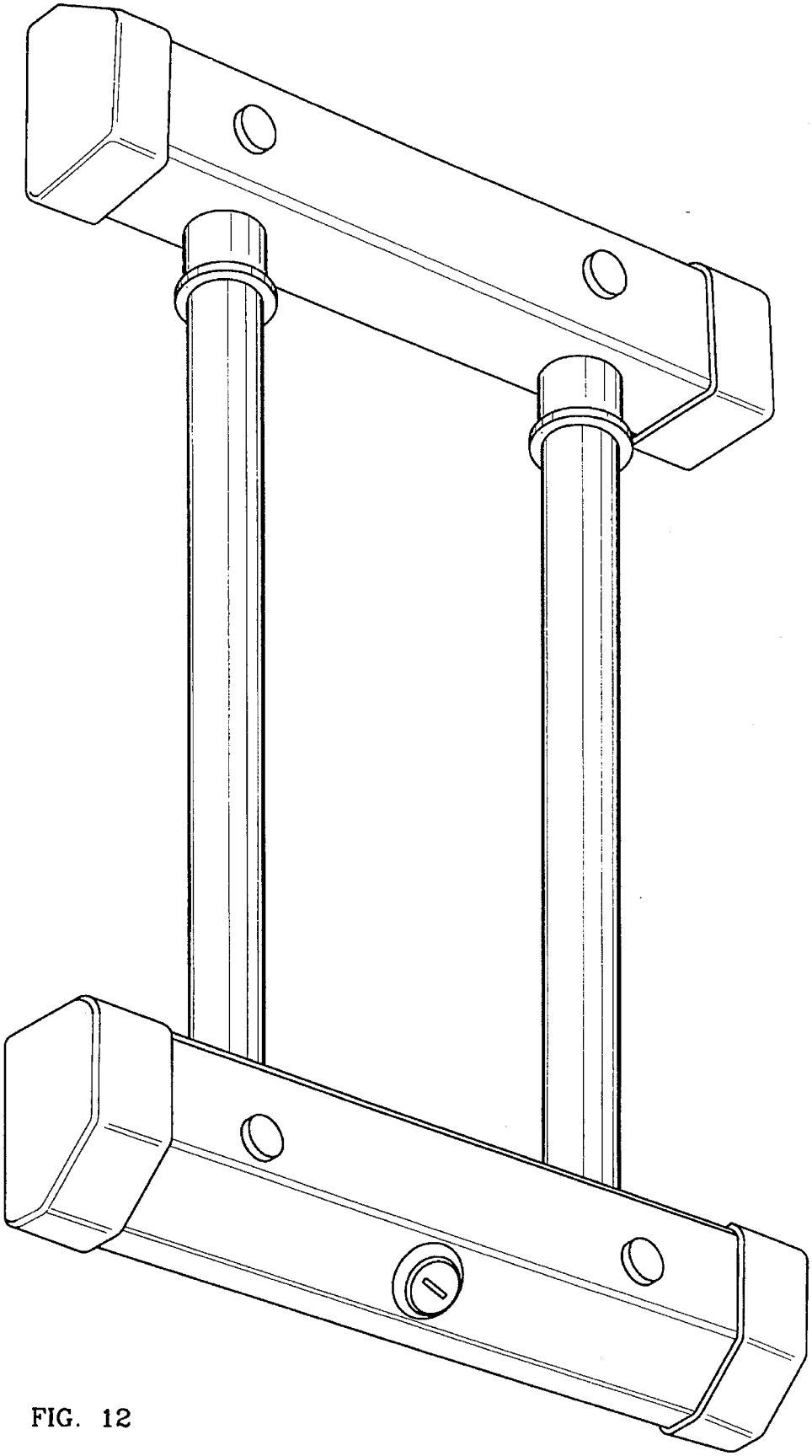
FIG. 12 is a diagrammatic perspective view the security grille of FIG. 11 fully assembled to a building.

An exploded diagrammatic view particularly showing how the mounting assemblies of a security grille in accordance with the present invention may be affixed to a building at positions orthogonal to the axis of the bars or tubes of such security grilles. The manner of assembling the security grille 1 of the present invention to a building shown in FIG. 11 may be repeated with variations for affixation that are both sideways and endwise to the spanning elements. A diagrammatic perspective view a security grille 1 of FIG. 11 fully assembled to a building is shown in FIG. 12.

Figure 13:
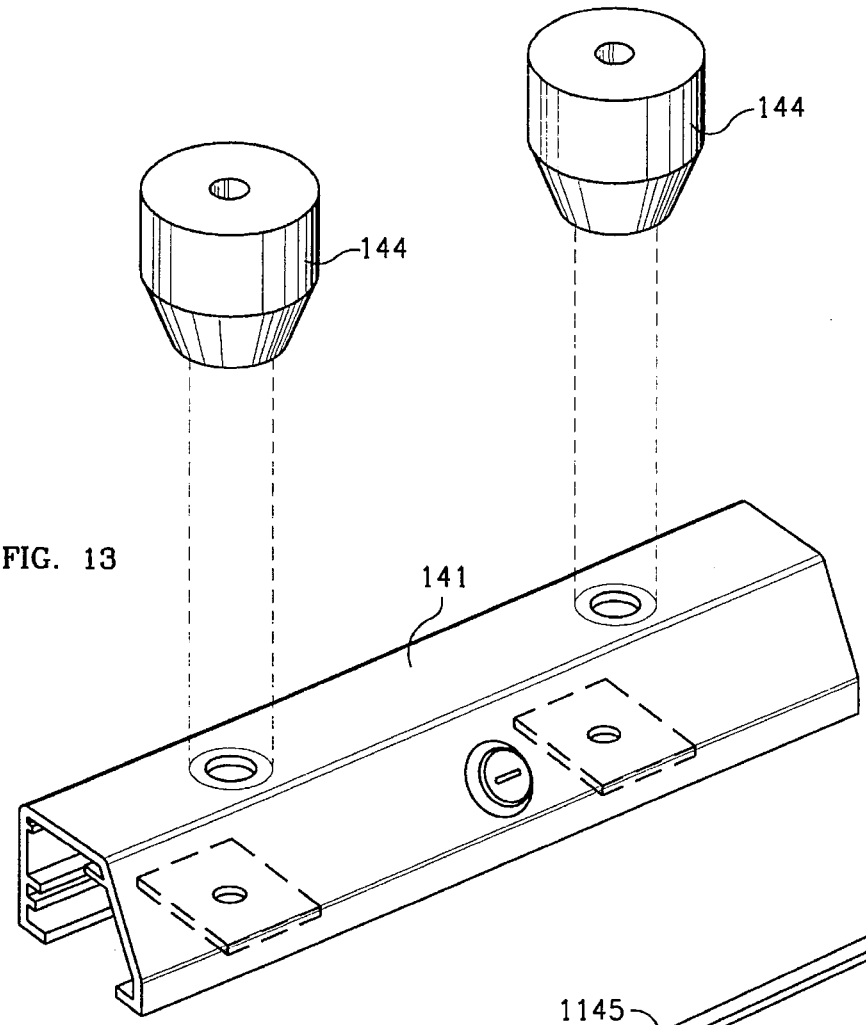
FIG. 13 is diagrammatic perspective view showing a single mounting assembly and two terminating cups suitable to hold two rods or tubes in a security grille in accordance with the present invention.

A diagrammatic perspective view showing a single mounting, or housing, assembly 141 and two terminating cups 144 suitable to hold two rods 112 or tubes 111 in a security grille 1 in accordance with the present invention is shown in FIG. 13.

Figure 14:
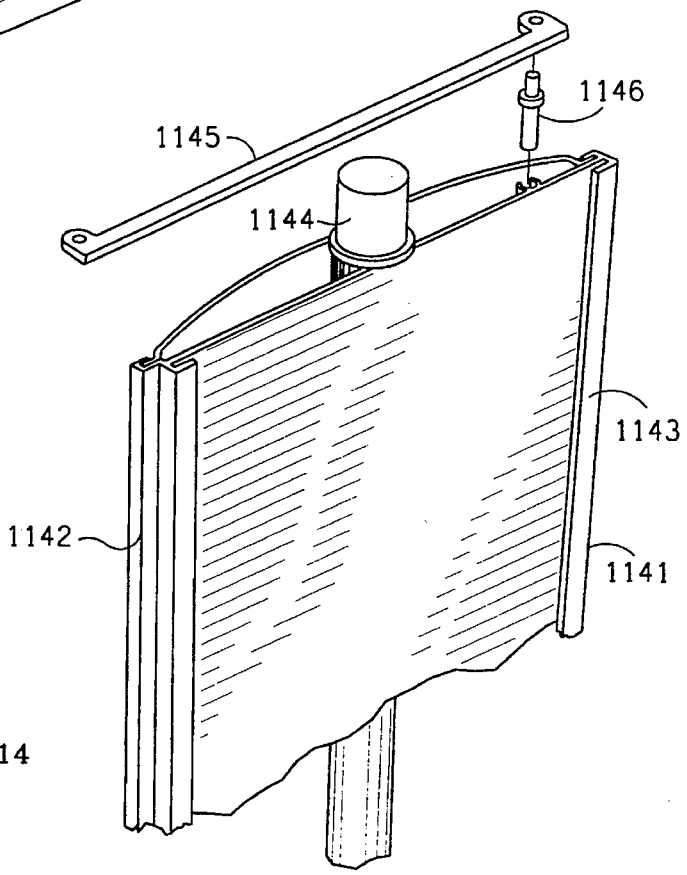
FIG. 14 is a diagrammatic perspective view of a snap-on fin suitably mounted to a bar or tube within a security grille in accordance with the present invention.

A diagrammatic perspective view of a snap-on fin 1141 suitably mounted to a bar 111 or a tube 112 within a security grille 1 in accordance with the present invention is shown in FIG. 14. The snap-on fin is commonly of plastic, but may be made of steel. It is commonly hollow, but may be filled with diverse fillers having, among other properties, thermal insulation and penetration resistance. Longitudinal side features 1142 and 1143 of the fin 1141 permit interlocking with adjacent fins in the manner of a closed louver, or shutter. A caps 1144 are provided, especially so as to cover lower metal which may be subject to corrosion, at the points of the entrance of the snap-on fin 114 into the upper and lower housing assemblies 141, 142 (shown in FIG. 1).

A pin 1145 connects to an linkage 1146 which in turn connects to the like pin of a next snap-on fin 114, or permanent fin 113 (the later of which is shown in FIG. 1). The linkage preserves that the rotational angle of all the fins 112, 113 is maintained equal for an improved aesthetic appearance, making the collective fins 112, 113 to function in the manner of a louver, or a shutter.

Figure 15:
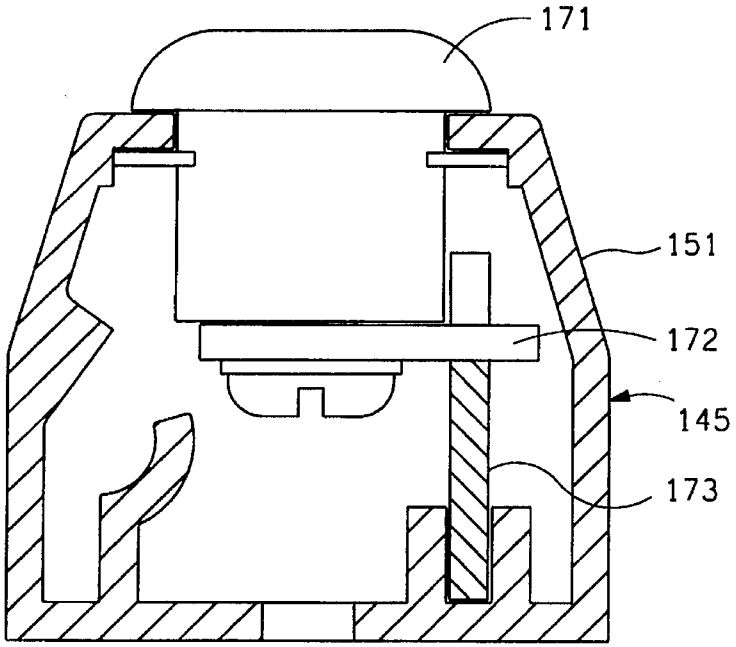
FIG. 15 Shows an alternative embodiment of a mounting assembly for a security grille in accordance with the present invention, particularly where a locked mechanism is positioned with a locked clip in place.

An alternative embodiment of a mounting, or housing, assembly 145 for a security grille 1 in accordance with the present invention is shown in FIG. 15. In this embodiment a spanning element 11 is pushed down to unlock as opposed to the previous embodiment wherein the spanning elements 11 were lifted up and out of their lower mounting,m or housing, assembly 142 (shown in FIG. 1).

No sockets 29 (see FIGS. 2 and 3) are used in conjunction with the mounting assembly 145, leaving the option to use tubular spanning elements 1i of any desired wall thickness, or even solid bars 112. This allows for a height up to six feet to be spanned without any bracing. The lower channel of the mounting, or housing, assembly 145 is also typically smaller than the channel of the previous lower mounting, or housing, assembly 142.

Figure 16:
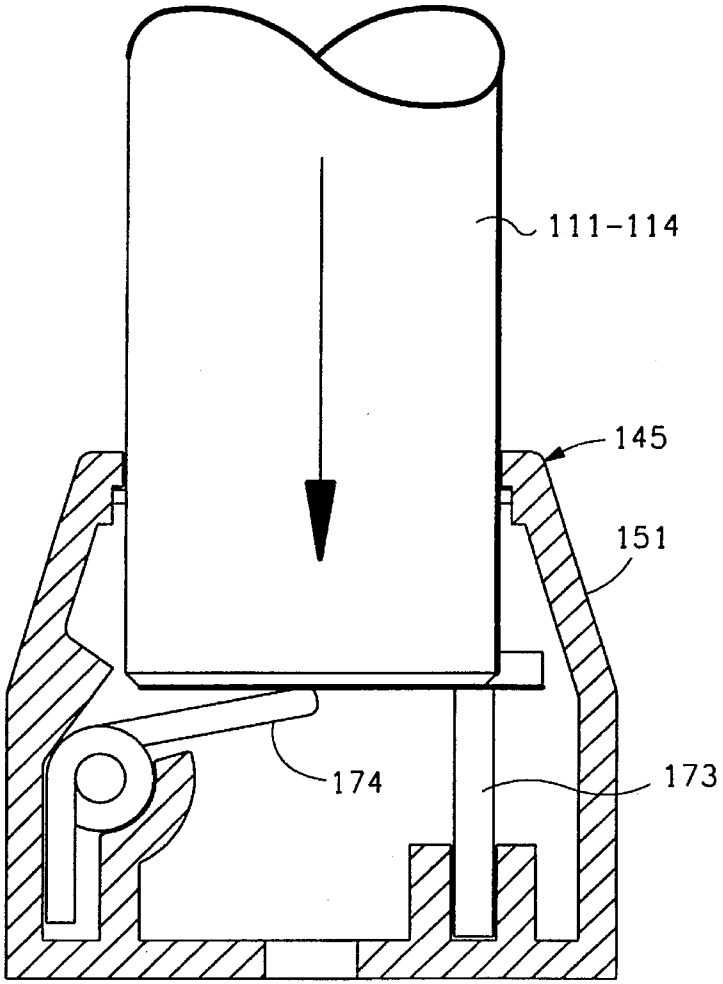
FIG. 16 shows the basic extrusion, and the manner of use with a security bar or tube, of the alternative embodiment of a mounting assembly of a security grille in accordance with the present invention previously seen in FIG. 15.

The locked position, with a lock 171 in place, is shown in FIG. 15. FIG. 16 shows how the lock 171 and a cam 172 operate the one piece slider 173 to permit the end of a spanning element 111–114 to be depressed down against the spring 174(shown in FIG. 16). The basic extrusion permits a 1" diameter tube 111 or bar 112—or any spanning element 11—to be used.

The operation of the mounting, or housing, assembly 145 is diagrammatically illustrated in FIGS. 15 and 16. The basic extrusion 151 permits a 1" locked position. Operation of lock 171 to its unlocked position causes the arm, or cam, 172 to move the bar 173 so a slot comes under the position of a spanning element 111–114. This permits the spanning element 111–114 to be pulled down into the mounting, or housing, assembly 145 against the pressure of spring 174, thereby disengaging a spanning element 111–114 from its top holder (not shown in FIGS. 15 and 16). The spanning element 111–114 can now be pulled out of the mounting, or housing, assembly 145. There is nothing to snag the spanning element 111–114 during its insertion or removal, and either end can be used.

The advantages of this embodiment are several. The profile of the extrusion is compact, and a wider range of tube, and/or bar, and/or fin sizes can be used. Expensive sockets are eliminated. No segmentation of the slider—flat or otherwise—is required for contour installations. No securing plates are used. The cost of production tooling is reduced.

In the final embodiment mounting, or housing, assembly 145, and in the previous embodiments, the extrusion profile 151 is commonly anodized finish aluminum, The slider 173 is commonly made from readily available strips of metal, commonly steel ⅛×1" CNC punched out, or laser cut.

In the final embodiment, the double torsion spring 174 shown in FIG. 16 is preferably CNC machine spring. The spanning elements 111–114 are typically a hefty 1" in diameter.

The top holders 144 shown in FIG. 13 are typically pressed or injection molded plastic.

Accordingly, the present invention has shown and described an embodiment of a security grille where fins of two types may be substituted for any or all bars.

In another embodiment of a security grille in accordance with the present invention, a particular type of fin may be fitted, and may more preferably be snap fitted, to any or all bars.

Several fins together form a shutter, or louver. Both the fins and bars are both (i) rotatable and (ii) removable for emergency escape through the window, for cleaning the window, and/or for similar legitimate purposes.

In accordance with the preceding explanation, variations and adaptations of security grilles in accordance with the present invention will suggest themselves to a practitioner of the mechanical design arts.

In accordance with these and other possible variations and adaptations of the present invention, the scope of the invention should be determined in accordance with the following claims, only, and not solely in accordance with that embodiment within which the invention has been taught.

What is claimed is:

1. A security grille for a structure having and defining a multi-sided window opening, the securitiy grille comprising:

spanning elements, each having a first end and a second end, for spanning the window opening, each of the spanning elements being individually interchangeably selected from the group consisting of bars, meaning elongate prisms having a maximum cross-sectional dimension that is less than 50% of a distance of separation between adjacent spanning elements in the security grill, and fins, meaning substantially planar elongate prisms having a maximum cross-sectional dimension that is more than 50% of the distance of separation between adjacent spanning elements in the security grill, where, in at least at a one of its first end and its second end, each of the spanning elements includes a stud portion;

a spanning element first-end support member, affixed to the structure at a first side of the window opening, for selectively receiving and engaging the first end of each of the spanning elements;

a spanning element second-end support member, affixed to the structure at a second side of the window opening opposite to the first side, for selectively receiving and engaging the second end, opposite to the first end, of each of the spanning elements, the spanning elements forming a security grille over the window opening when their first and their second ends are selectively respectively received and engaged by the first-end and the second-end support members;

at least a one of the spanning element first-end support member and the spanning element second-end support member that receives and engages the at least one stud portion end of the spanning elements including a housing, a securement means for securing the housing to the structure at a side of the structure's multi-sided window opening, openings in the housing to accept the stud portion of each of the spanning elements, a slide means, having and defining catch means suitable to engage the stud portions of spanning elements, mounted for sliding in the housing for sliding movement between a first, stud-locking position where the catch means secures the stud portions of the spanning elements, securing the spanning elements to the housing and thus to the structure, and a second, stud-disengaging, position where the catch means releases the stud portion of the spanning elements, permitting removal of the spanning elements from the housing, and locking means to retain the slide means in its first, stud-locking, position.

2. The security grille according to claim 1 wherein the bars are rotatable in their engagements by the first-end and the second-end support members, and wherein the fins comprise:

shutters affixed to the rotatable bars and rotating therewith.

3. The security grille according to claim 2 wherein the shutters have a cross-sectional dimension that spans the distance of separation between rotatable bars, and are axially mounted on the rotatable bars for rotation therewith, so that two such shutters rotationally mounted on adjacent bars may be rotated into alignment such as produces and presents a solid surface between the two bars;

wherein the shutters thus rotated present a security panel.

4. The improvement to the security grille according to claim 1 wherein the locking means further comprises:

linkage means for moving the slide means between its first and its second positions.

5. The improvement to the security grille according to claim 4 wherein the end one of the spanning element first-end support member and the spanning element second-end support member that receives and engages the at least one stud portion end of the spanning elements further comprises:

a release mechanism manually triggered to act upon the locking means so as to cause the locking means to move through its linkage means to slide the slide means from the first to the second position; and trigger means manually actuated for triggering the release mechanism.

6. The improvement to the security grille according to claim 5 wherein the release mechanism comprises:

a spring, connected between the slide means and the locking means, for storing energy serving to aid the locking means to act through its linkage means to move the slide means from its first to its second position.

7. The improvement to the security grille according to claim 5 wherein the trigger means is remotely situated from the locking means.

8. The improvement to the security grille according to claim 5 wherein the manually actuated trigger means comprises:

a manually actuated foot pedal remotely situated from the locking means; and a cable for transmitting force between the foot pedal and the release mechanism.

9. A housing assembly for a security grille for use on a structure having and defining a multi-sided window opening, the security grille having spanning elements, each having a first end and a second end where a stud portion is located on at least a one end, spanning the window opening, a spanning element first-end support member, affixed to the structure at a first side of the window opening, for selectively receiving and engaging the first end of each of the spanning elements, and a spanning element second-end support member, affixed to the structure at a second side of the window opening opposite to the first side, for selectively receiving and engaging the second end, opposite to the first end, of each of the spanning elements, wherein the spanning elements form a security grille over the window opening when their first and their second ends are selectively respectively received and engaged by the first-end and the second-end support members, the housing assembly comprising:

a housing;

securement means for securing the housing to the structure at a side of the structure's multi-sided window opening;

openings in the housing to accept the stud portion of each of the spanning elements;

a slide means, having and defining catch means suitable to engage the stud portions of spanning elements, mounted in the housing for sliding movement between a first, stud-locking position where the catch means secures the stud portions of the spanning elements, securing the spanning elements to the housing and thus to the structure, and a second, stud-disengaging, position where the catch means releases the stud portion of the spanning elements, permitting removal of the spanning elements from the housing;

locking means to moving the slide means between, and retaining the slide means at, each of its first, stud-locking, position and its second, stud-disengaging, positions;

a release mechanism manually triggered to act upon the locking means so as to cause the locking means to move the slide means from the first to the second position; and a trigger means manually activated for triggering the release mechanism.

10. The housing assembly for a security grille according to claim 9 wherein the release mechanism comprises:

a spring, connected between the slide means and the locking means, for storing energy serving to aid the locking means to act through its linkage means to move the slide means from its first to its second position.

11. The housing assembly for a security grille according to claim 9 wherein the trigger means is remotely situated from the locking means.

12. The housing assembly for a security grille according to claim 9 in combination with a manually actuated foot pedal remotely situated from the locking means; and a cable for transmitting force between the foot pedal and the release mechanism.

13. A security grille for use on a structure having and defining a multi-sided window opening, the security grille comprising:

solid spanning elements in the shape of elongate regular prisms without differentiated features upon their elongate surfaces nor their ends;

a spanning element first-end support member, affixed to the structure at a first side of the window opening, for selectively receiving and engaging the first end of each of the spanning elements, and a spanning element second-end support member, affixed to the structure at a second side of the window opening opposite to the first side, for selectively receiving and engaging the second end, opposite to the first end, of each of the spanning elements, the spanning element second-end support member having a body attachment means for attaching the body to the structure at a side of the structure's multi-sided window opening;

openings in the body to accept an end portion of each of the spanning elements;

a slide means, having and defining both (i) extension means suitable to butt against the end portion of each of the spanning elements, and (ii) notch means suitable to receive the end portion of each of the spanning elements, mounted in the body for sliding movement between a first position where the extension means holds the end portion of each of the spanning elements in such extension as causes each such spanning element to be simultaneously engage d and held in each of the openings in the second-end support member's body and in the first-end support member, and a second position where the extension means permits the end portion of each of the spanning elements to recess within the openings of the second-end support member's body sufficiently so as to be extracted and released from the first-end support member; and locking means for moving the slide means between, and retaining the slide means at, each of its first, spanning element-retaining, position and its second, spanning element-disengaging, positions;

wherein the spanning elements form a security grille over the window opening when their first and their second ends are selectively respectively received and engaged by the first-end and the second-end support members.

14. The security grille according to claim 13 wherein the spanning element second-end support member further comprises:

a release mechanism manually triggered to act upon the locking means so as to cause the locking means to move the slide means from the first to the second position; and a trigger means manually activated for triggering the release mechanism.

* * * * *